US008844841B2

(12) United States Patent
Prater et al.

(10) Patent No.: US 8,844,841 B2
(45) Date of Patent: Sep. 30, 2014

(54) NOZZLE ASSEMBLY FOR LIQUID DISPENSER

(75) Inventors: Rodney L. Prater, Oak Creek, WI (US); Cary E. Manderfield, Racine, WI (US); Sean Petersen, Evansville, WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 544 days.

(21) Appl. No.: 12/383,019

(22) Filed: Mar. 19, 2009

(65) Prior Publication Data

US 2010/0237159 A1 Sep. 23, 2010

(51) Int. Cl.

| | |
|---|---|
| ***B05B 1/32*** | (2006.01) |
| ***B05B 1/16*** | (2006.01) |
| *B05B 1/12* | (2006.01) |
| *B05B 11/00* | (2006.01) |
| *B05B 1/02* | (2006.01) |

(52) U.S. Cl.

CPC ..... *B05B 11/0029* (2013.01); *B05B 1/12* (2013.01); *B05B 11/3057* (2013.01); *B05B 1/02* (2013.01); *B05B 1/1654* (2013.01)

USPC ..... 239/396; 239/394; 239/442; 239/452; 239/581.1

(58) Field of Classification Search

USPC ..... 239/391–394, 396, 452, 457, 581.1, 239/437, 442, 436

See application file for complete search history.

(56) References Cited

U.S. PATENT DOCUMENTS

| | | | | |
|---|---|---|---|---|
| 2,132,333 A | * | 10/1938 | Sargent et al. | 239/394 |
| 3,843,030 A | | 10/1974 | Micallef | |
| 3,967,765 A | | 7/1976 | Micallef | |
| 4,020,982 A | | 5/1977 | Micallef | |
| 4,247,048 A | | 1/1981 | Hayes | |
| 4,618,100 A | | 10/1986 | White et al. | |
| 4,690,312 A | * | 9/1987 | Crapser et al. | 222/402.17 |
| 4,706,888 A | | 11/1987 | Dobbs | |
| 4,779,803 A | | 10/1988 | Corsette | |
| 4,867,380 A | | 9/1989 | Sibbertsen | |

(Continued)

FOREIGN PATENT DOCUMENTS

| | | |
|---|---|---|
| GB | 2293336 A | 3/1996 |
| JP | H02-268852 | 11/1990 |
| WO | WO 2009/030579 | 3/2009 |

OTHER PUBLICATIONS

"Choice of Spray Pumps Rests on Carful Testing", Mark R. Harris, Nov. 1986, 3 pages.

(Continued)

*Primary Examiner* — Jason Boeckmann

(57) ABSTRACT

A nozzle assembly for a liquid dispenser includes an outlet member that defines a liquid supply conduit and a nozzle that includes an exit orifice, wherein the nozzle is disposed over an end of the outlet member. A liquid compression path is defined by the nozzle and the outlet member, wherein the liquid compression path includes a liquid compression chamber that supplies liquid from the liquid supply conduit to the exit orifice. The nozzle is adjustable between a first spray position for projecting a liquid spray having a first average droplet size and a second spray position for projecting a liquid spray having a first average droplet size. In the first spray position the liquid compression chamber has a first volume and in the second spray position the liquid compression chamber has a second volume. Preferably, the liquid spray is formed without a swirl chamber.

14 Claims, 14 Drawing Sheets

(56) References Cited

U.S. PATENT DOCUMENTS

| | | | | |
|---|---|---|---|---|
| 4,890,792 | A | 1/1990 | Martin et al. | |
| 4,903,897 | A * | 2/1990 | Hayes | 239/394 |
| 4,991,778 | A | 2/1991 | Maas et al. | |
| 5,088,628 | A | 2/1992 | Knickerbocker | |
| 5,183,322 | A * | 2/1993 | Haruch | 239/394 |
| 5,267,692 | A | 12/1993 | Maas et al. | |
| 5,337,926 | A | 8/1994 | Drobish et al. | |
| 5,358,179 | A | 10/1994 | Lund et al. | |
| 5,368,234 | A | 11/1994 | Foster et al. | |
| 5,386,940 | A * | 2/1995 | Berfield | 239/394 |
| 5,411,185 | A | 5/1995 | Drobish | |
| 5,499,766 | A | 3/1996 | Foster et al. | |
| 5,513,800 | A | 5/1996 | Foster et al. | |
| 5,535,950 | A | 7/1996 | Barriac et al. | |
| 5,553,752 | A | 9/1996 | Foster et al. | |
| 5,560,545 | A | 10/1996 | Grogan et al. | |
| 5,570,840 | A | 11/1996 | Gettinger et al. | |
| 5,590,837 | A | 1/1997 | Grogan | |
| 5,664,732 | A | 9/1997 | Smolen, Jr. et al. | |
| 5,678,765 | A | 10/1997 | Dobbs et al. | |
| 5,687,877 | A | 11/1997 | Smolen, Jr. | |
| 5,755,384 | A | 5/1998 | Foster et al. | |
| 5,878,959 | A | 3/1999 | Smolen, Jr. et al. | |
| 5,947,340 | A | 9/1999 | Arnold et al. | |
| 6,050,457 | A | 4/2000 | Arnold et al. | |
| 6,105,882 | A | 8/2000 | Woltjen | |
| 6,116,472 | A | 9/2000 | Wanbaugh et al. | |
| 6,126,090 | A | 10/2000 | Wadsworth et al. | |
| 6,149,077 | A | 11/2000 | Pohler | |
| 6,194,470 | B1 | 2/2001 | Lutz et al. | |
| 6,446,882 | B1 | 9/2002 | Dukes et al. | |
| 6,481,643 | B1 * | 11/2002 | Chen | 239/390 |
| 6,978,946 | B2 | 12/2005 | Sweeton | |
| 6,997,397 | B1 | 2/2006 | Keung et al. | |
| 7,021,571 | B1 | 4/2006 | Lawson et al. | |
| 7,354,008 | B2 | 4/2008 | Hester et al. | |
| 2006/0065765 | A1 | 3/2006 | Hester et al. | |
| 2008/0217262 | A1 | 9/2008 | Van Rijn | |

OTHER PUBLICATIONS

PCT/US2010/000791 International Search Report dated Aug. 23, 2010.

* cited by examiner

NOZZLE ASSEMBLY FOR LIQUID DISPENSER

CROSS REFERENCE TO RELATED APPLICATIONS

Not applicable

REFERENCE REGARDING FEDERALLY SPONSORED RESEARCH OR DEVELOPMENT

Not applicable

SEQUENTIAL LISTING

Not applicable

BACKGROUND OF THE INVENTION

1. Field of the Invention

The present disclosure relates generally to nozzle assemblies for liquid dispensers and, more particularly, to nozzle assemblies capable of producing different liquid output patterns.

2. Description of the Background of the Invention

Liquid dispensers can take on various general forms, e.g., trigger sprayers, finger type pumps, aerosol dispensers, etc. Further, nozzle assemblies can be coupled to such liquid sprayers to project different liquid output patterns, e.g., a stream, a divergent or conical spray pattern, aerated foam, and the like. The design of such nozzle assemblies generally depends on the intended application and/or the characteristics of the liquid that is dispensed.

For example, if the liquid is intended to be suspended in the air, a nozzle assembly to project a divergent spray may be used, but if the liquid is intended to be applied to a surface, e.g., carpet, wood, a painted surface, etc., a nozzle assembly to project a stream or foam may be used.

Nozzle assemblies that are designed to project a divergent spray typically include a swirl chamber that is directly upstream from an exit orifice. In a typical swirl chamber, a vortex is created in the chamber by restricting the liquid to enter the chamber through one or more generally tangential paths before exiting through the exit orifice. Such tangential paths include obstructions that substantially block direct radial flow paths to the exit orifice. In contrast, if a stream pattern is desired, the fluid is allowed to flow through a substantially direct radial flow path to the exit orifice.

SUMMARY OF THE INVENTION

According to one embodiment, a nozzle assembly for a liquid dispenser includes an outlet member that defines a liquid supply conduit and a nozzle that includes an exit orifice extending therethrough, wherein the nozzle is disposed over an end of the outlet member. A liquid compression path is defined by the nozzle and the outlet member, wherein the liquid compression path includes a liquid compression chamber that supplies liquid from the liquid supply conduit to the exit orifice. The nozzle is adjustable between a first spray position for projecting a liquid spray having a first average droplet size and a second spray position for projecting a liquid spray having a second average droplet size greater than the first average droplet size. In the first spray position the liquid compression chamber has a first volume and in the second spray position the liquid compression chamber has a second volume larger than the first volume. The liquid spray is formed without a swirl chamber directly upstream from the exit orifice.

According to another embodiment, a method of using a single adjustable nozzle assembly for broadcasting a liquid as a first liquid spray output having a first average droplet diameter size into the air with minimal liquid droplet fallout and for applying the liquid as a second liquid spray output having a second average droplet diameter size onto a surface includes the step of providing a single adjustable nozzle assembly. The nozzle assembly defines a discrete first liquid compression path and a discrete second liquid compression path and does not provide a continuously variable adjustment between the first and second liquid compression paths. The method also includes the steps of adjusting the nozzle assembly to form the first liquid compression path, pumping a liquid through the first liquid compression path, generating a first liquid spray output from the nozzle assembly, wherein the first liquid spray has an average droplet diameter size selected to minimize droplet fallout onto surrounding surfaces by ensuring substantial evaporation into surrounding air, and directing the first liquid spray output into the surrounding air in a manner selected to allow substantially complete evaporation of the first liquid spray output before encountering the surrounding surfaces. Further, the method includes the steps of adjusting the nozzle assembly to form the second liquid compression path, pumping the liquid through the second liquid compression path, generating a second liquid spray output from the nozzle assembly that has an average droplet diameter size at least about double an average droplet size of the first liquid spay output, and directing the second liquid spray output against a surface.

According to yet another embodiment, a nozzle assembly for a liquid dispenser includes an outlet member that defines a liquid supply conduit and a nozzle that includes an exit orifice, wherein the nozzle is disposed over an end of the outlet member. A liquid compression path is defined between the nozzle and the outlet member, wherein the liquid compression path includes a liquid compression chamber that supplies liquid from the liquid supply conduit to the exit orifice. The liquid compression chamber is directly upstream of the exit orifice and provides a substantially unobstructed direct radial flow path to the exit orifice. The nozzle is adjustable between a first spray position for projecting a divergent liquid spray having a first average droplet size and a second spray position for projecting a divergent liquid spray having a second average droplet size greater than the first average droplet size. The first average droplet size is between about 40 micrometers and about 60 micrometers and the second average droplet size is between about 90 micrometers and about 120 micrometers.

Other aspects and advantages of the present invention will become apparent upon consideration of the following detailed description.

DETAILED DESCRIPTION OF THE DRAWINGS

Figure 1:
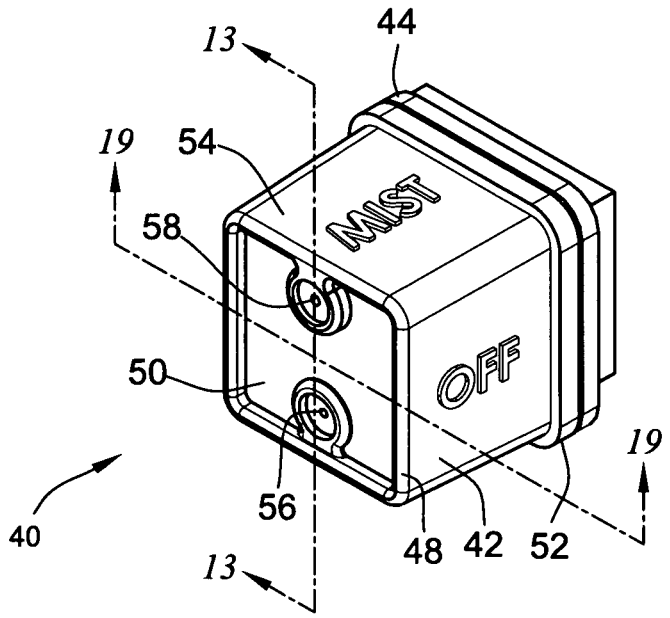
FIG. 1 is an isometric view of a nozzle assembly according to the present invention.

The present disclosure is directed to a nozzle assembly that can be coupled to a dispensing end of a liquid dispenser, such as a trigger sprayer, finger type pump, aerosol dispenser, and the like. The nozzle assembly is adjustable between various functional positions or settings to project different liquid output patterns. Preferably, the nozzle assembly is adapted to project different divergent or conical spray outputs with a spray cone angle from between about 5 degrees to about 90 degrees and the spray outputs have average liquid droplet sizes that are less than about 120 microns. Such spray outputs are distinguishable from foaming output patterns, non-divergent stream patterns, and divergent stream patterns. Further, prior art nozzle assembles that generate a divergent spray commonly include a swirl chamber directly upstream of an exit orifice. The typical swirl chamber generally restricts the flow of a liquid to a tangential path directly upstream from the exit orifice in order to produce a vortex of fluid entering the exit orifice to subsequently create the divergent spray. In contrast, the present nozzle assembly, in some instances, generates divergent spray outputs without creating a vortex with a swirl chamber directly upstream of an exit orifice. Rather, such nozzle assemblies disclosed herein include a substantially unobstructed direct radial flow path to the exit orifice to produce a divergent spray without creating a vortex. Still further, the present nozzle assembly preferably can be adjusted between at least two different settings in order to generate divergent spray outputs having different average liquid droplet sizes by varying the size of a liquid compression chamber that is directly upstream from an exit orifice. In one example, the nozzle assembly is adjustable between first and second discrete spray positions to generate specific spray outputs with distinct average droplet sizes. The discrete spray positions prevent the nozzle assembly from providing a continuously variable adjustment between the first and second spray positions. However, in other examples, the nozzle assembly is adjustable between a plurality of spray positions that can be discrete or continuous or any combination of discrete and continuous. As used herein, a discrete spray position is a single position and is not continuously variable between an infinite number of intermediate spray positions.

In yet another example, the nozzle assemblies disclosed herein are adapted for use with a liquid, such as an air freshener, deodorizer, cleaning agent, and any combination of the like, that has intended uses when dispensed as a first divergent spray that suspends in the air and when dispensed as a second divergent spray that is applied to a surface. In such applications, the first and second divergent sprays should provide a generally even dispersion of the liquid and it may be useful to have divergent spray patterns with different average droplet sizes. For example, the first divergent spray can have a smaller average droplet size to suspend an aerosol-like spray into the air with minimal liquid droplet fallout. Droplet fallout describes the action of having, for example, aerosolized liquid particles fall from the surrounding air environment onto surrounding surfaces, such as a floor or furniture, before completely or substantially evaporating into the air, which can cause the surfaces to feel wet to the touch and may be undesirable to a user. The smaller average droplet size of the first divergent spray promotes the substantially complete evaporation of the liquid before encountering an object when directed into the air away from any obstructing objects. Thus, the first divergent spray is particularly suited for dispensing the liquid as an air freshener that substantially completely evaporates into the air to provide a longer lasting ambient effect. However, as would be understood by one of skill in the art, some components of the liquid may not completely evaporate into the air. Instead, such non-evaporating components generally break down into even smaller particle sizes as the other evaporating components of the liquid do evaporate. The smaller particle sizes of the non-evaporating components are normally sufficiently small so that they do not contribute to any noticeable undesirable effects to a user.

Further, the second divergent spray can have a larger average droplet size to provide a targeted application of the liquid to a surface for a specific purpose, e.g., as a deodorizer or cleaning agent. In one non-limiting example, the second average droplet spray can be applied to a stain on a fabric, wherein the larger average droplet size allows the liquid to be applied directly to the surface without substantial evaporation of the liquid and to penetrate the stain to provide a more effective deodorizing or cleaning function. In one example, the second divergent spray applied to a surface preferably has a generally conical spray geometry with a diameter at a surface between about 6 inches (about 15 cm) and about 14 inches (about 36 cm) when generated between about 10 inches (about 25 cm) and about 18 inches (about 46 cm) from the surface to which it is being applied. In another example, the second divergent spray has a generally conical spray geometry with a diameter at a surface of about 10 inches (about 25 cm) when generated at about 14 inches (about 36 cm) from the surface to which it is being applied. Such spray geometries in terms of shape, size, and distance from a surface have been found to apply the liquid to the surface in an optimal and even manner.

In one preferred example, the larger and smaller average droplet diameter sizes are generally less than about 120 microns and the larger average droplet diameter size is approximately double the smaller average droplet diameter size. Preferably, the larger average droplet size is generally between about 90 microns to about 120 microns and the smaller average droplet size is generally between about 40 microns to about 60 microns. In yet a further example, the larger average droplet size is about 100 microns and the smaller average droplet size is about 40 microns. Such average droplet sizes can be measured using any suitable particle analyzer, such as a Mastersizer particle analyzer manufactured by Malvern Instruments Ltd., of Worcestershire, UK.

At normal environmental conditions, e.g., room temperature and 50% relative humidity, and when the spray is projected from a typical trigger sprayer, droplet sizes between about 40 microns and about 60 microns will usually result in substantially complete evaporation of the liquid before encountering an object when directed into the air away from any obstructing objects. However, even at diameter sizes between about 40 microns and about 60 microns, some components of the liquid may not completely evaporate into the air. Instead, such non-evaporating components, such as surfactants, often shrink or break down into even smaller particle sizes as the other evaporating components of the liquid do evaporate. In one example, at normal environmental conditions, the non-evaporating components often may shrink or break down into particles of about 10-20 microns or smaller in average diameter within about 2-3 feet (about 0.5-1.0 meters) from the nozzle assembly. Such small particle sizes of the non-evaporating components generally do not contribute to any noticeable undesirable effects to a user.

Figure 2:
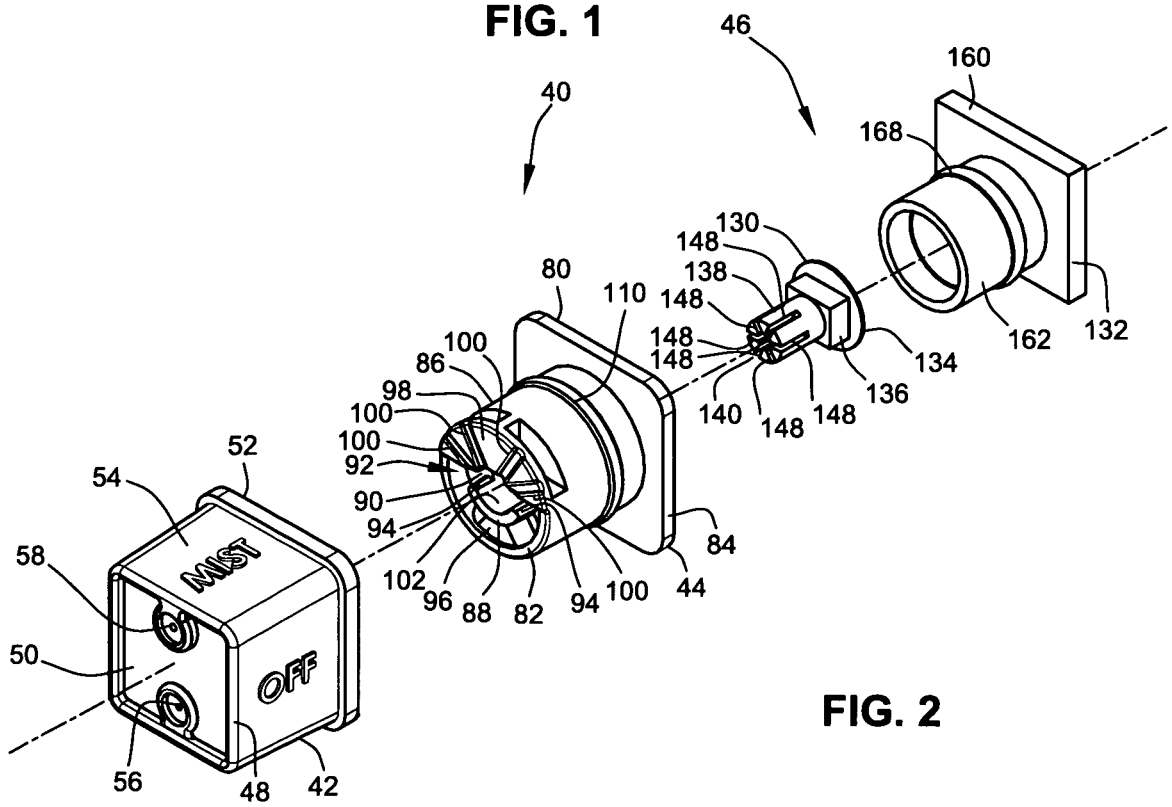
FIG. 2 is an exploded isometric view of the nozzle assembly of FIG. 1.

FIG. 1 illustrates one example of a nozzle assembly 40 that can be coupled to a dispensing end of a liquid dispenser, an example of which is shown by an outlet member of FIG. 2, as would be apparent to one of ordinary skill. The nozzle assembly 40 is rotatably adjustable between successive functional positions to project or generate different divergent liquid spray outputs or to prevent the projection of a liquid output. In the present embodiment, the nozzle assembly 40 appears generally rectangular and each side of the rectangle includes raised lettering or other indicia to indicate the current setting. For example, when the nozzle assembly 40 is coupled to a liquid dispenser, a top surface of the nozzle assembly 40 provides an indication of the current setting, e.g., "MIST" in FIG. 1. In one example intended without limitation, the other successive sides of the nozzle assembly 40 are marked with "OFF," "SPRAY" (not shown), and "OFF" (not shown) in a clockwise manner.

Referring to FIG. 2, the nozzle assembly 40 includes a nozzle 42 disposed over a preference valve 44, which is further disposed over an outlet member 46. The nozzle 42 includes a first end 48 that is closed by an end wall 50 and a second open end 52 that is defined by a side wall 54 that extends from a periphery of the end wall 50. The nozzle 42 has a generally rectangular exterior cross-sectional outline but in other embodiments can take on other exterior cross-sectional shapes, e.g., circular, square, or other symmetrical or abstract shapes. The nozzle 42 also includes first and second exit orifices 56, 58, respectively, disposed through the end wall 50. In the present example, the first and second exit orifices 56, 58 are diametrically aligned. However, in other embodiments the position and alignment of the first and second exit orifices 56, 58 can be modified without departing from the spirit of the present disclosure.

Figure 3:
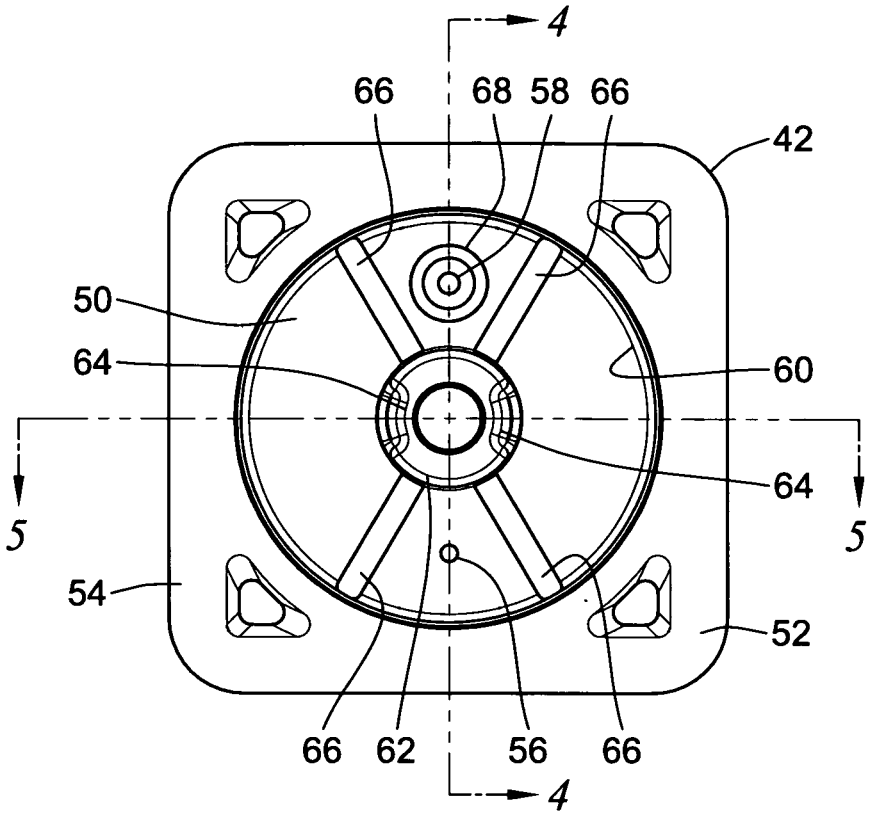
FIG. 3 is a back elevational view of a nozzle according to FIG. 1.
Figure 4:
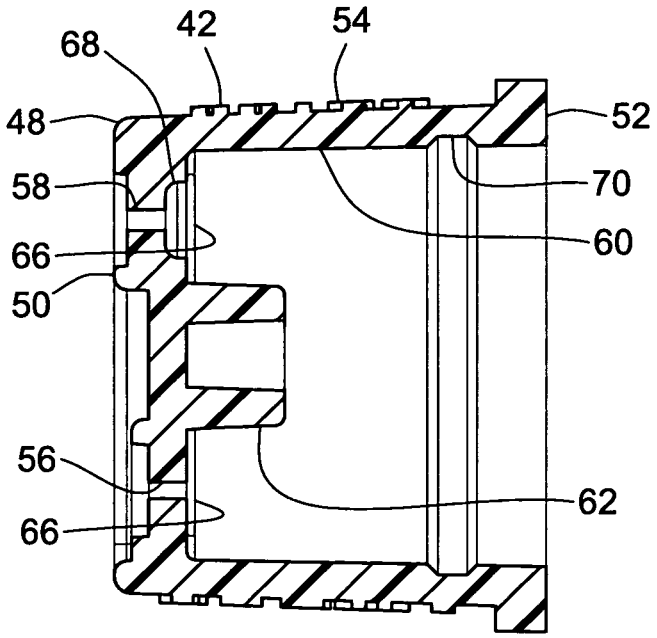
FIG. 4 is a cross-sectional view taken generally along line 4-4 of FIG. 3.
Figure 5:
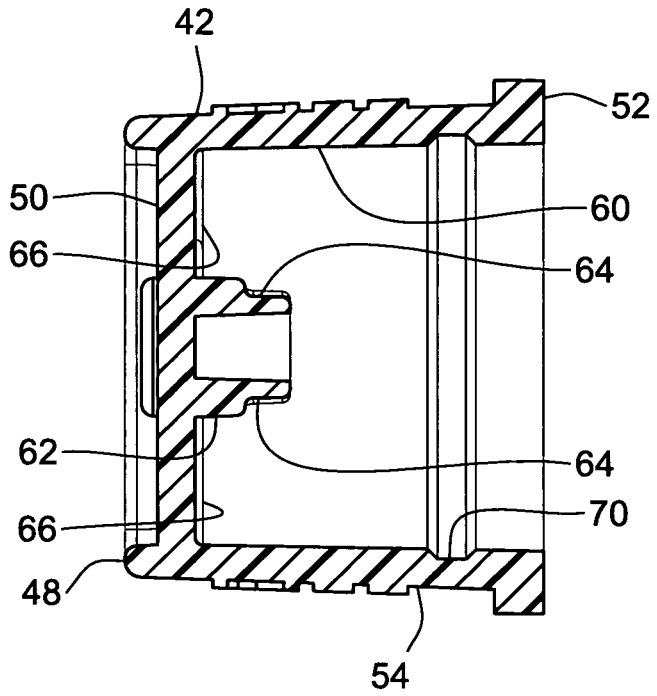
FIG. 5 is a cross-sectional view taken generally along line 5-5 of FIG. 3.

With additional reference to FIGS. 3-5, the side wall 54 of the nozzle 42 defines a generally cylindrical cavity 60. A generally cylindrical central plug 62 extends from a central region of the end wall 50 into the cavity 60, and laterally opposed openings or recesses 64 are disposed in a distal end of the central plug 62. In other examples, the central plug 62 may include fewer or additional openings therein. The end wall 50 adjacent the cavity 60 also includes axially extending ridges 66 that are disposed on opposite sides of each of the first and second exit orifices 56, 58. Referring more specifically to FIG. 4, the end wall 50 adjacent the cavity 60 includes a recess 68 around the second exit orifice 58 but is generally planar around the first exit orifice 56. Additionally, FIGS. 4 and 5 illustrate an annular groove or recess 70 that is disposed in the side wall 54 adjacent the cavity 60.

The first and second exit orifices 56, 58 can be any size and shape but are generally cylindrical in the present non-limiting example. Further, the first and second exit orifices 56, 58 can be the same or different sizes and shapes. In the present example, the second exit orifice 58 is larger than the first exit orifice 56. More specifically, the second exit orifice 58 has a larger diameter than the first exit orifice 56. In one example, the second exit orifice 58 has a diameter that is between about 0.017 inches (about 0.44 mm) to about 0.021 inches (about 0.53 mm) and the first exit orifice 56 has a diameter that is about 0.013 inches (about 0.33 mm) to about 0.017 inches (about 0.44 mm). In another example, the second exit orifice 58 has a diameter that is about 0.019 inches (about 0.48 mm) and the first exit orifice 56 has a diameter that is about 0.015 inches (about 0.38 mm). Alternatively or in conjunction, the lengths of the first and second exit orifices 56, 58 can be varied. In one example, the lengths of the first and second exit orifices 56, 58 are between about 0.055 inches (about 1.40 mm) to about 0.035 inches (about 0.89 mm). In another example, the lengths of the first and second exit orifices 56, 58 are about 0.045 inches (about 1.14 mm).

Referring now to FIGS. 2 and 6-8, the preference valve 44 is a generally cylindrical member with an inlet end 80 and a discharge end 82. A planar, generally rectangular end wall 84 is disposed at the inlet end 80 and an outer tubular wall 86 extends from the end wall 84 to the discharge end 82. An inner tubular wall 88 is radially spaced within the outer tubular wall 86 and is connected thereto by an end wall 90 that extends therebetween. The end wall 90 is spaced from the discharge end 82 of the preference valve 44 to define a recessed channel 92. Radially opposed openings 94 are disposed through the inner tubular wall 88 proximate the discharge end 82. In other examples, the inner tubular wall 88 may include fewer or additional openings therethrough. Further, a hump or step 96 is disposed in the recessed channel 92 between a first side of the opposed openings 94. In the present example, the hump 96 is spaced generally half-way between the opposed openings 94. The hump 96 includes a planar top and there is a smooth, generally parabolic transition from the end wall 50 to a base and a top of the hump 96. However, in other examples, modifications can be made to the hump 96 without departing from the spirit of the present disclosure, such as modifying the hump 96 to include channels and/or cavities disposed therein (not shown).

Figure 6:
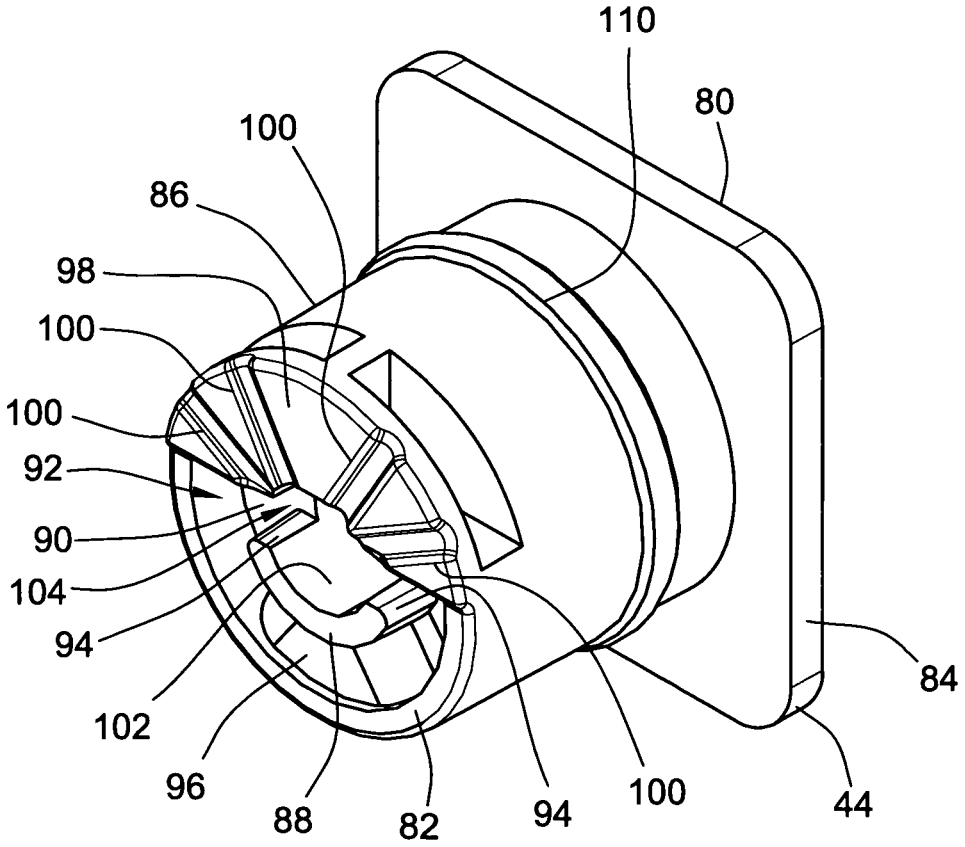
FIG. 6 is an enlarged isometric view of a preference valve according to FIG. 1.

The preference valve 44 further includes a wall 98 that is disposed between a second side of the opposed openings 94 diametrically opposite the recessed channel 92. In the present example, the wall 98 extends substantially between the opposed openings 94 and projects past ends of the outer and inner tubular walls 86, 88. The wall 98 functions to block an exit orifice that is not in use, as will be described in more detail hereinafter. Consequently, modifications to the wall 98 are contemplated that still allow the wall 98 to perform such function. FIG. 6 also shows a plurality of radial channels 100 recessed into the wall 98 that interact with the ridges 66 in the nozzle 42 to further block an exit orifice that is not in use. The radial channels 100 also affect snap-type position stops for each of the various functional positions of the nozzle assembly 40.

Figure 7:
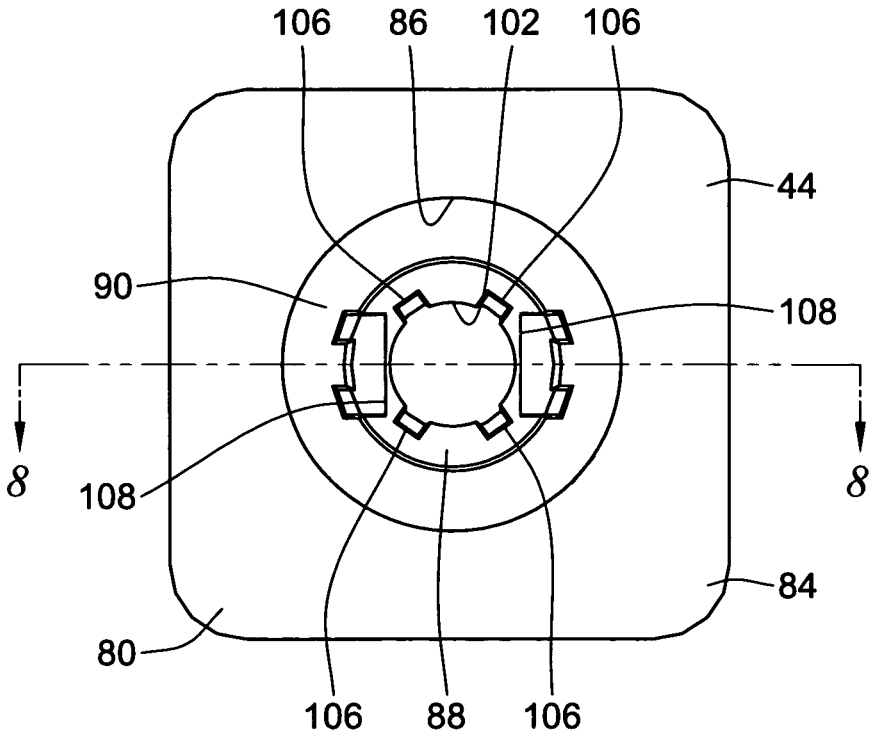
FIG. 7 is a back elevational view of the preference valve of FIG. 6.
Figure 8:
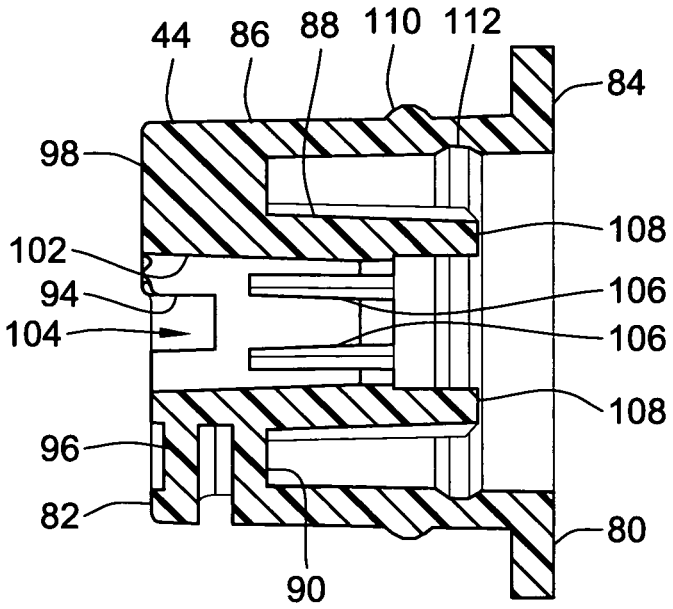
FIG. 8 is a cross-sectional view taken generally along line 8-8 of FIG. 7.

Referring more specifically to FIGS. 7 and 8, the inner tubular wall 88 defines an axial passageway 102 therethrough. In addition, the opposed openings 94 through the inner tubular wall 88 form one or more radial passageways 104 from the axial passageway 102 to the recessed channel 92. Further, one or more channels 106 extend axially along the inner tubular wall 88 adjacent the axial passageway 102. The preference valve 44 also includes an anti-rotation feature so that the preference valve 44 is substantially rotatably fixed with respect to the outlet member 46. FIGS. 7 and 8 illustrate one example of such an anti-rotation feature as a pair of fingers 108 that extend from the inner tubular wall 88. The fingers 108 interact with structures on the outlet member 46 to prevent rotation of the preference valve 44 on the outlet member 46, as will be described in more detail hereinafter. In other examples, different anti-rotation features can be used, as would be apparent to one of ordinary skill.

Figure 13:
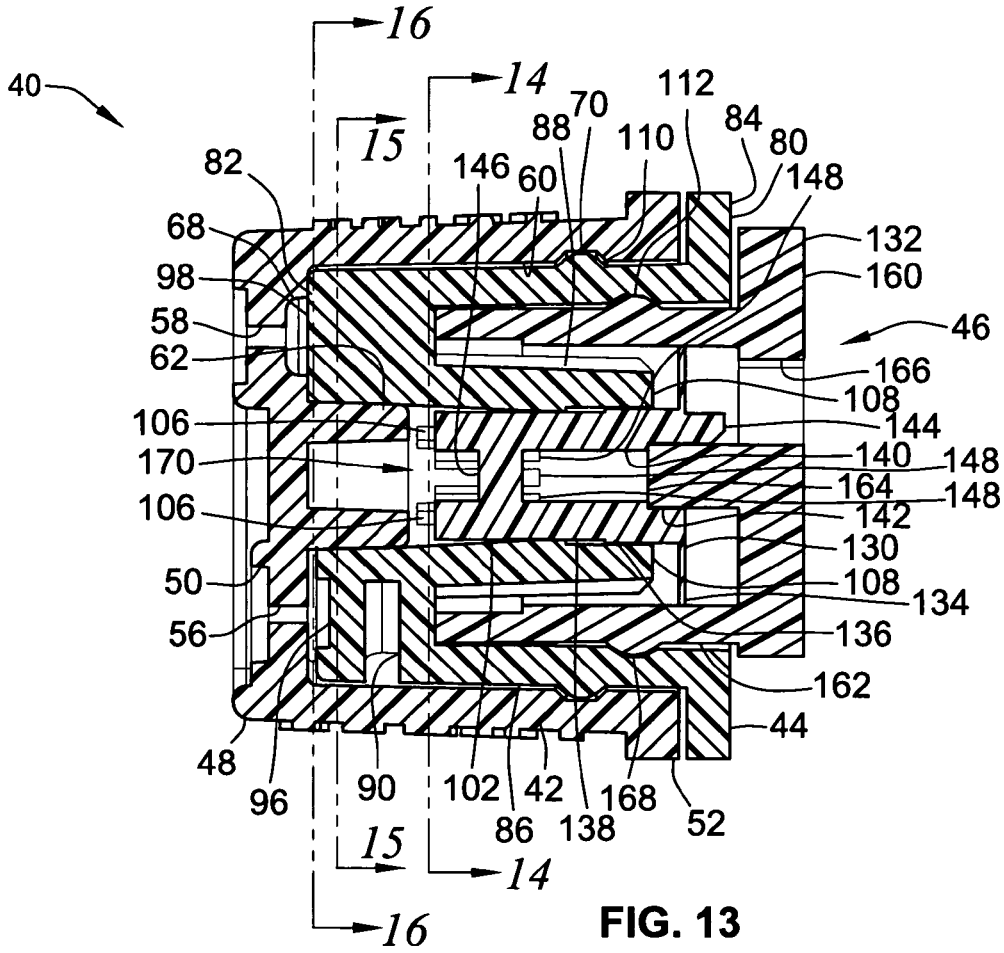
FIG. 13 is a cross-sectional view taken generally along lines 13-13 of FIG. 1 with the nozzle assembly in a first spray position.

FIGS. 6 and 8 also illustrate an annular rib 110 disposed on the outer tubular wall 86 spaced from the end wall 90. FIG. 13 shows that the annular recess 70 of the nozzle 42 is disposed over the annular rib 110 of the preference valve 44 to rotatably mount the nozzle 42 onto the preference valve 44. FIG. 8 further shows an annular recess 112 in the outer tubular wall 86 that interacts with the outlet member 46, as will be described in more detail hereinafter.

Figure 9:
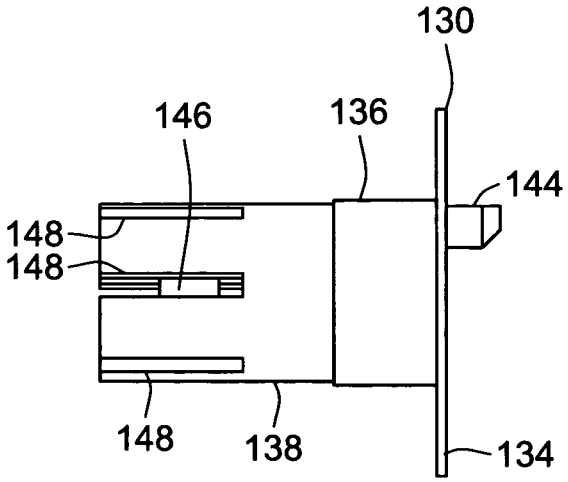
FIG. 9 is a side elevational view of a discharge valve according to FIG. 2.
Figure 10:
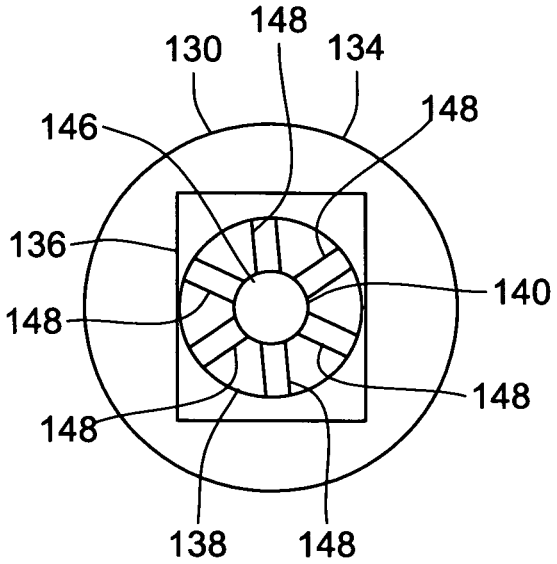
FIG. 10 is a front elevational view of the discharge valve of FIG. 9.
Figure 11:
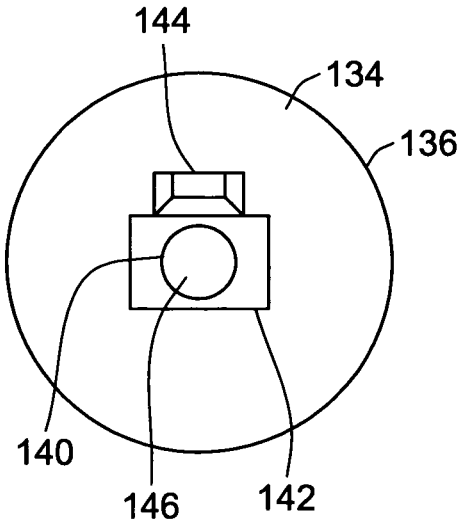
FIG. 11 is a back elevational view of the discharge valve of FIG. 9.

In the present disclosure, the outlet member 46 generally defines a conduit that supplies liquid from the dispensing end of a liquid dispenser to a nozzle and out one or more exit orifices. By way of non-limiting example, FIGS. 2 and 9-12 illustrate the outlet member 46 with a discharge valve 130 disposed within a valve body 132 to define a liquid supply conduit. The discharge valve 130 includes a circular end wall 134, a rectangular column 136 extending from the end wall 134, and a generally cylindrical member 138 projecting axially from the rectangular column 136. Referring more particularly to FIGS. 9-11, a central bore 140 is further defined through the column 136 and the cylindrical member 138. The central bore 140 includes a rectangular chamber 142 defined by portions of the column 136 and the end wall 134. FIG. 9 shows a finger 144 that extends from the end wall 134 adjacent the rectangular chamber 142. In the present example, the cylindrical member 138 also includes a plug 146 disposed in the central bore 140 and one or more axial channels 148 that extend through the cylindrical member 138 to the central bore 140. Referring to FIG. 10, the present example includes six axial channels 148 that extend radially through the cylindrical member 138 to the central bore 140.

Figure 12:
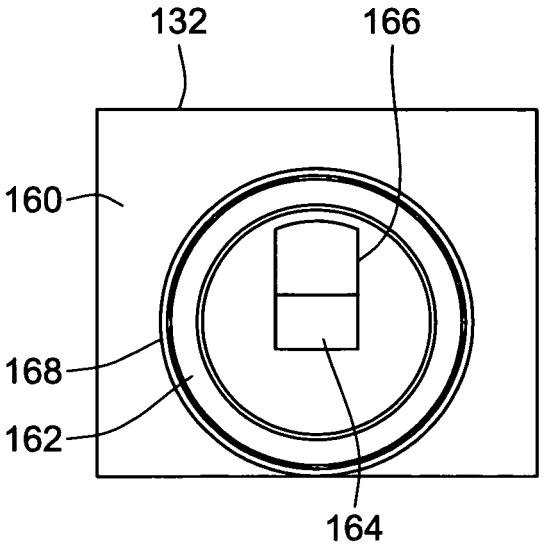
FIG. 12 is a front elevational view of a valve body according to FIG. 2.

Referring to FIGS. 2, 12, and 13, the valve body 132 includes a base wall 160 with a cylindrical column 162 that extends therefrom. A rectangular plug 164 extends from the base wall 160 within the cylindrical column 162 and an aperture 166 is disposed through the base wall 160 adjacent the plug 164. Additionally, the cylindrical column 162 includes an annular rib 168, wherein the annular recess 112 of the preference valve 44 is disposed over the annular rib 168 to secure the preference valve 44 to the valve body 132, as shown in FIG. 13, for example.

FIG. 13 further shows that when the nozzle 42 is disposed over the preference valve 44, the central plug 62 is disposed within the axial passageway 102 defined by the inner tubular wall 88 of the preference valve 44. The cylindrical member 138 of the discharge valve 130 is also disposed within the axial passageway 102 of the preference valve 44 such that a cavity 170 is formed between the central plug 62 and the cylindrical member 138. Further, the fingers 108 of the preference valve 44 engage sides of the rectangular column 136 of the discharge valve 130 to provide the anti-rotation feature discussed above. In addition, the discharge valve 130 is disposed within the cylindrical column 162 of the valve body 132 so that the rectangular plug 164 is disposed within the rectangular chamber 142. The nozzle 42, preference valve 44, discharge valve 130, and cylindrical column 162 are all preferably aligned along a single axis as seen in FIGS. 2 and 13.

Figure 14:
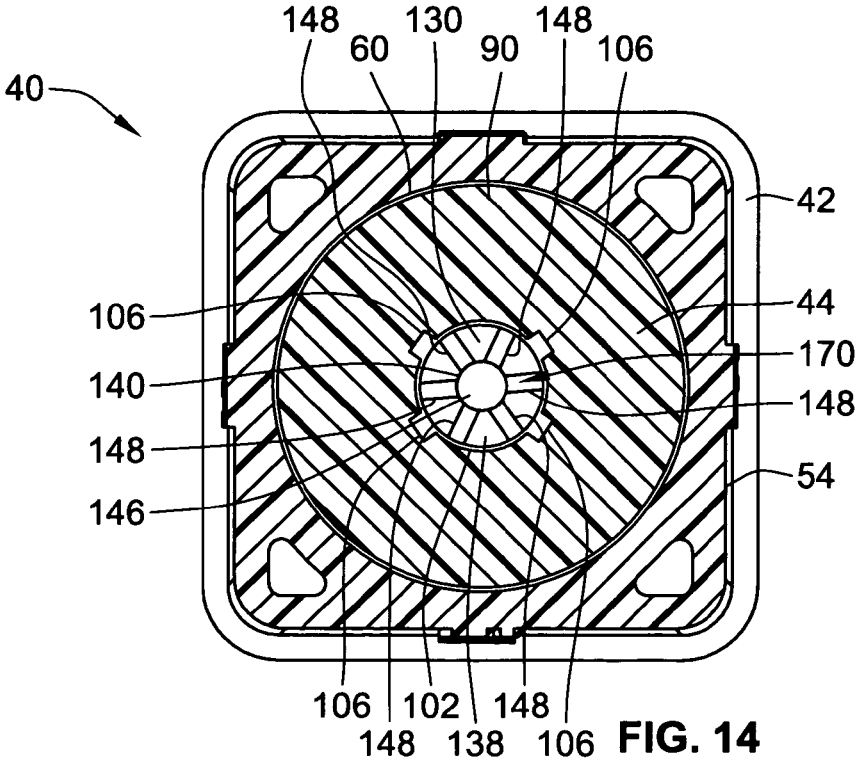
FIG. 14 is a cross-sectional view taken generally along lines 14-14 of FIG. 13.
Figure 15:
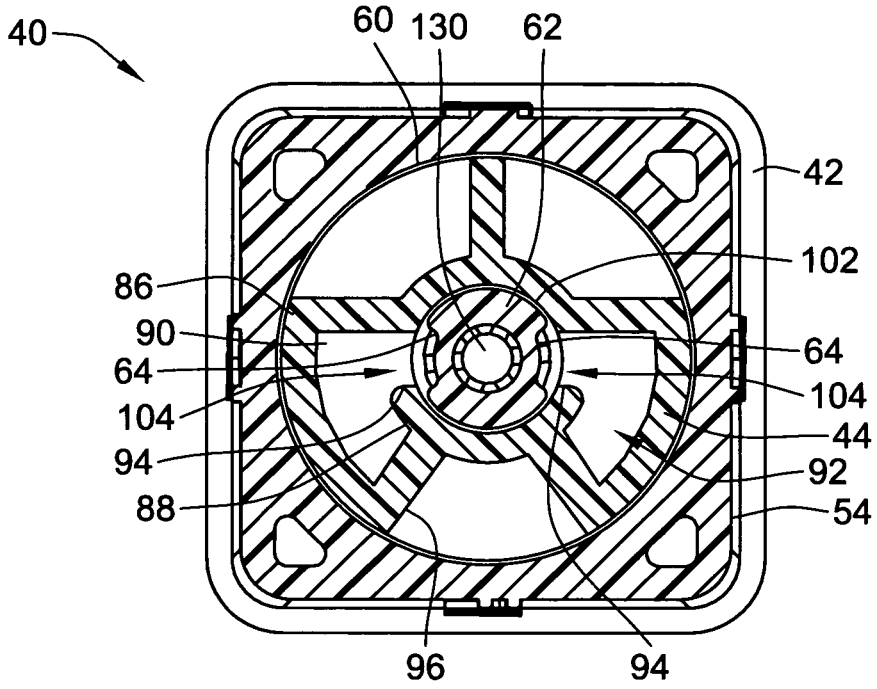
FIG. 15 is a cross-sectional view taken generally along lines 15-15 of FIG. 13.
Figure 16:
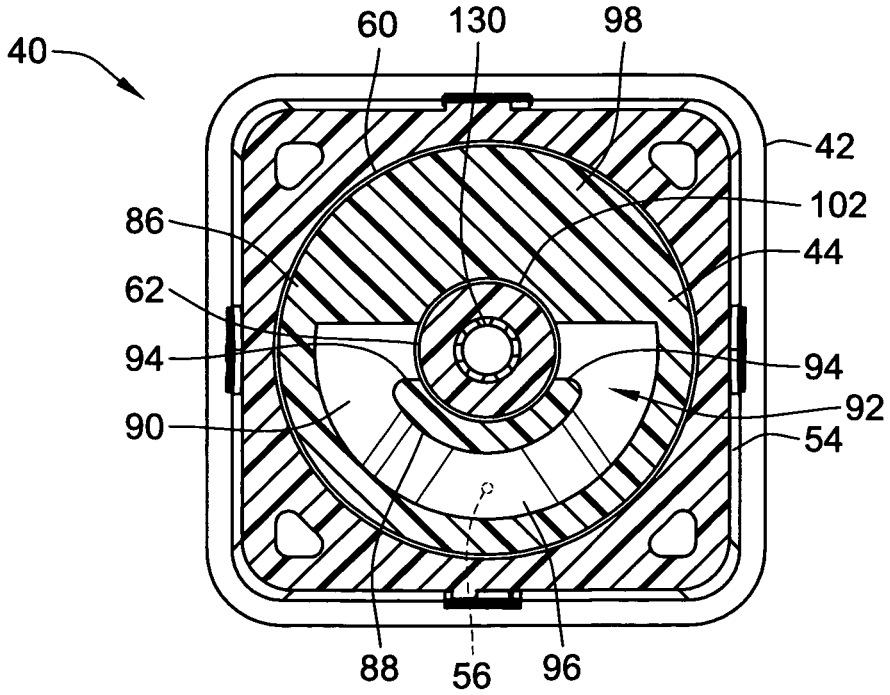
FIG. 16 is a cross-sectional view taken generally along lines 16-16 of FIG. 13.

In one non-limiting example of the nozzle assembly 40 in use, liquid flows through the aperture 166 in the base wall 160 of the valve body 132 and past a periphery of the end wall 134 of the discharge valve 130. The end wall 134 resiliently flexes toward the cylindrical member 138 to allow the liquid to pass and resiliently closes when there is no forward pressure on the end wall 134. In the present example, the discharge valve 130 and the end wall 134 function as a check valve that only allows liquid to flow in one direction through the nozzle assembly 40 and out an exit orifice. Referring to FIGS. 13 and 14, after the liquid flows past the end wall 134 of the discharge valve 130, the liquid flows through the channels 106 disposed in the inner tubular wall 88 of the preference valve 44 and into the cavity 170.

Figure 17:
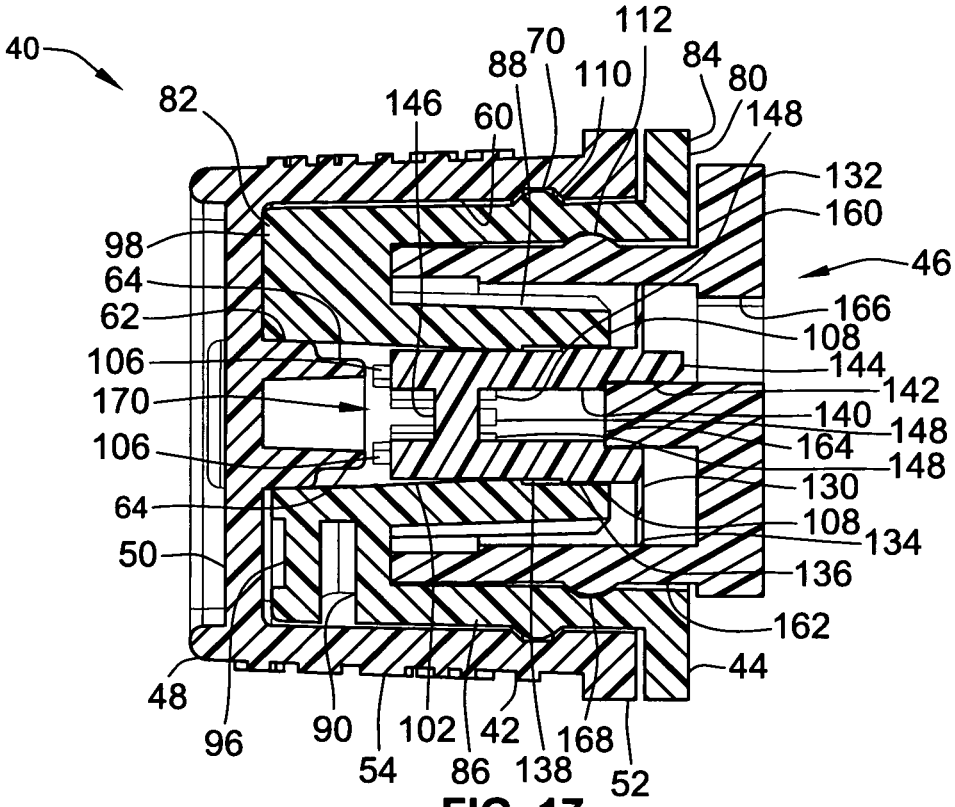
FIG. 17 is a cross-sectional view similar to FIG. 13 with the nozzle assembly in an off position.
Figure 18:
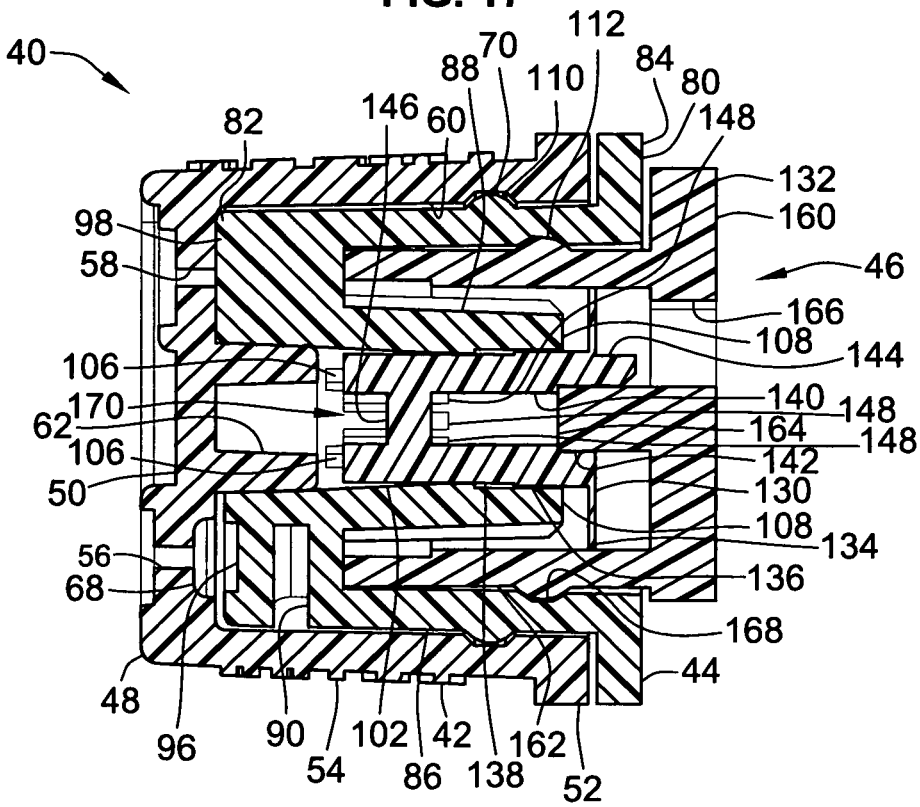
FIG. 18 is a cross-sectional view similar to FIG. 13 with the nozzle assembly in a second spray position.
Figure 19:
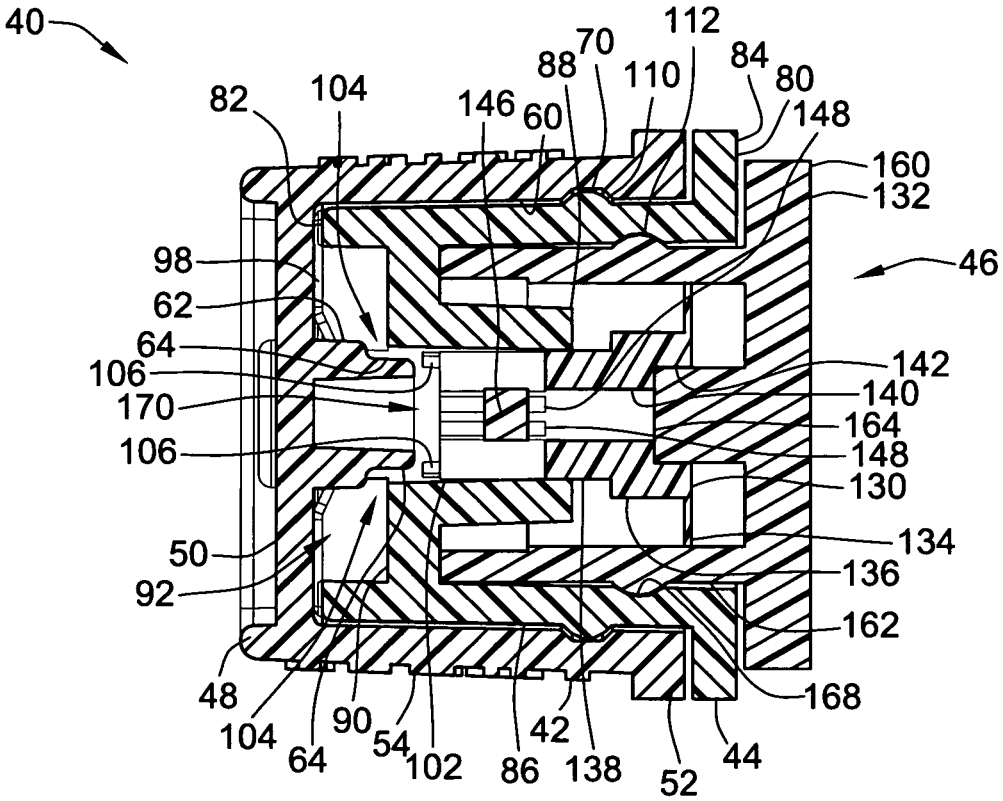
FIG. 19 is a cross-section view taken generally along lines 19-19 of FIG. 1 with the nozzle assembly in a first spray position.
Figure 20:
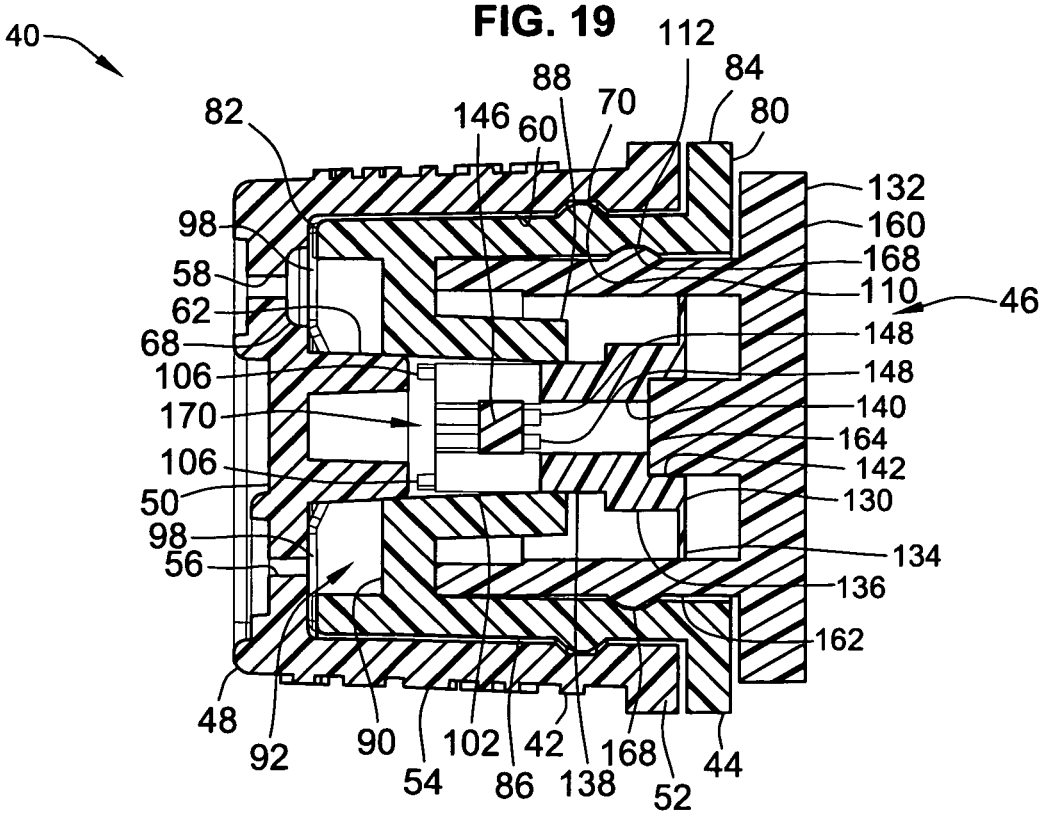
FIG. 20 is a cross-sectional view similar to FIG. 19 with the nozzle assembly in an off position.
Figure 21:
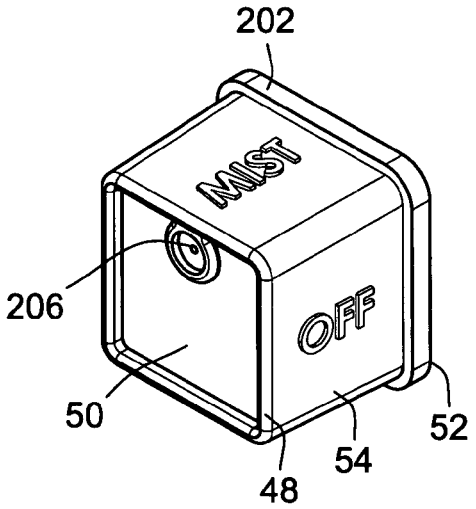
FIG. 21 is an isometric view of a further nozzle according to the present invention.
Figure 22:
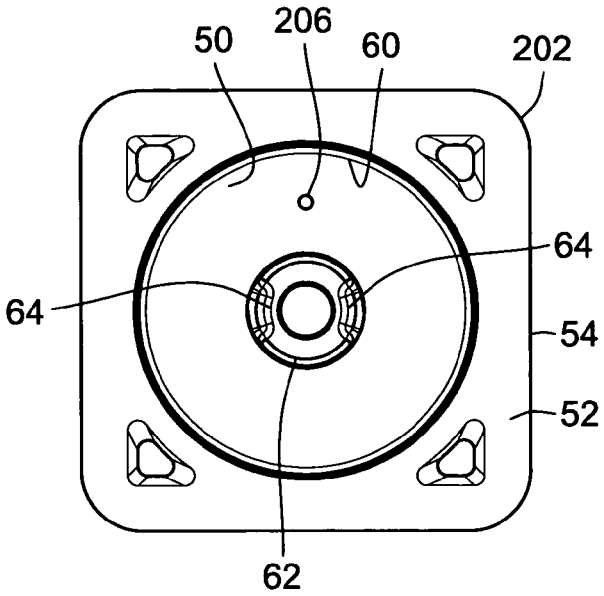
FIG. 22 is a back elevational view of the nozzle of FIG. 21.
Figure 23:
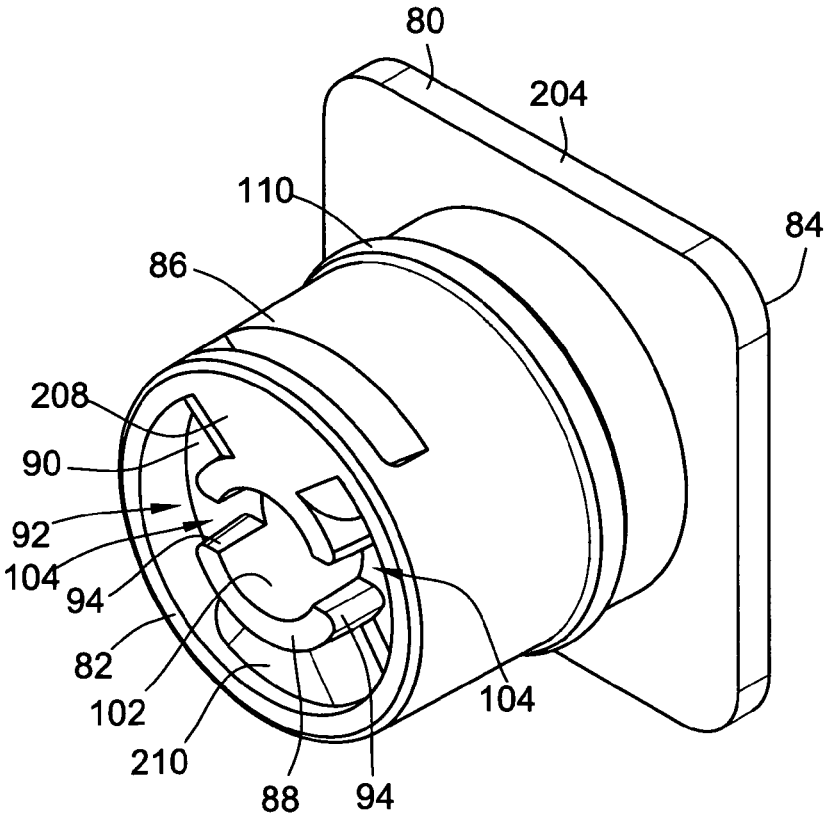
FIG. 23 is an isometric view of another preference valve for use with the nozzle of FIG. 21.
Figure 24:
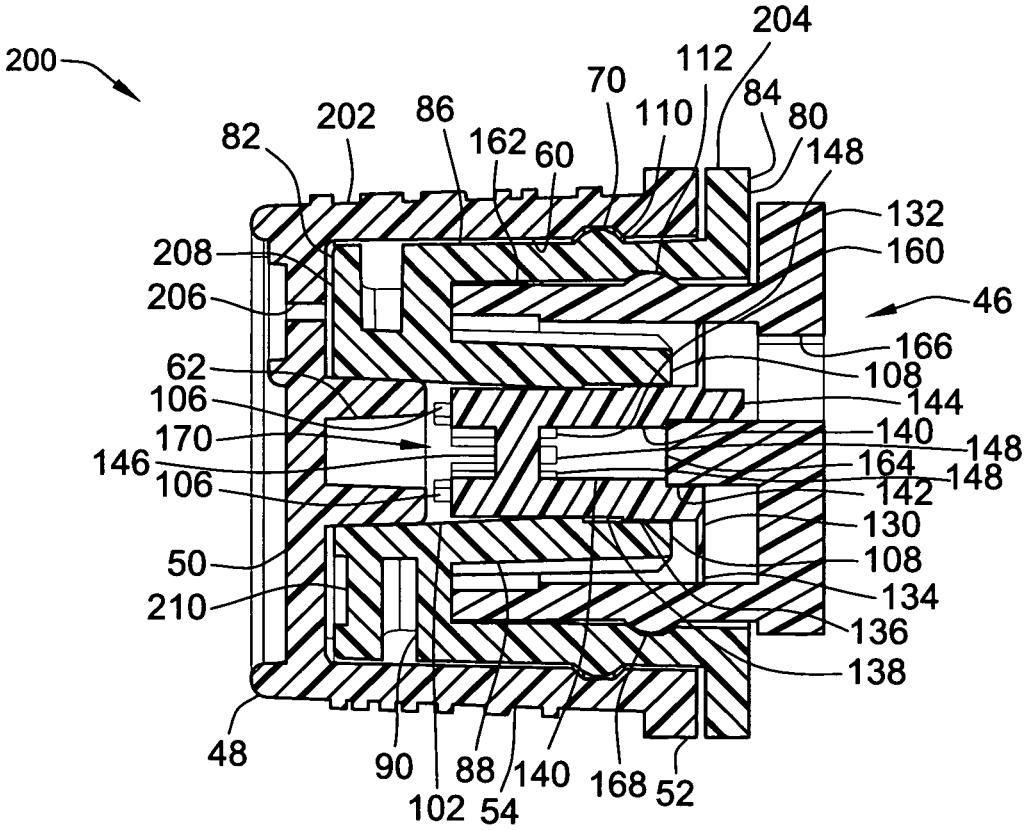
FIG. 24 is a cross-sectional view similar to FIG. 13 with the nozzle and the preference valve of FIG. 13 replaced by the nozzle of FIG. 21 and the preference valve of FIG. 23, respectively, wherein the nozzle assembly is in a first spray position.
Figure 25:
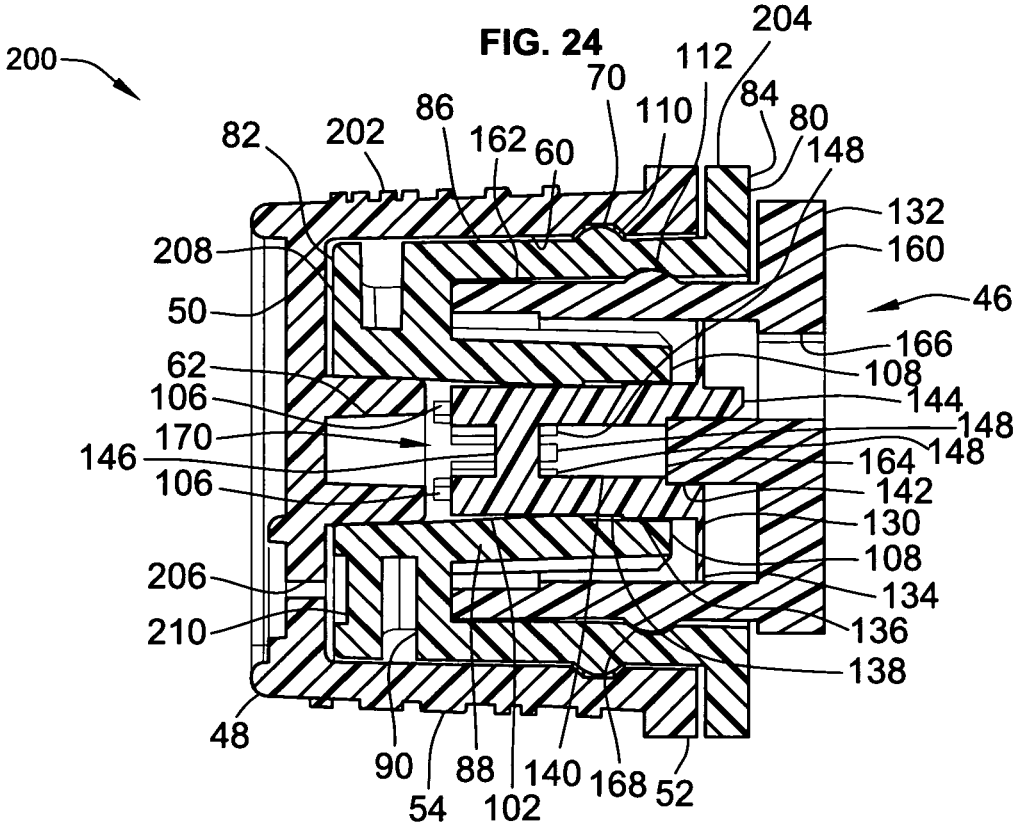
FIG. 25 is a cross-sectional view similar to FIG. 24 with the nozzle assembly in a second spray position.
Figure 26:
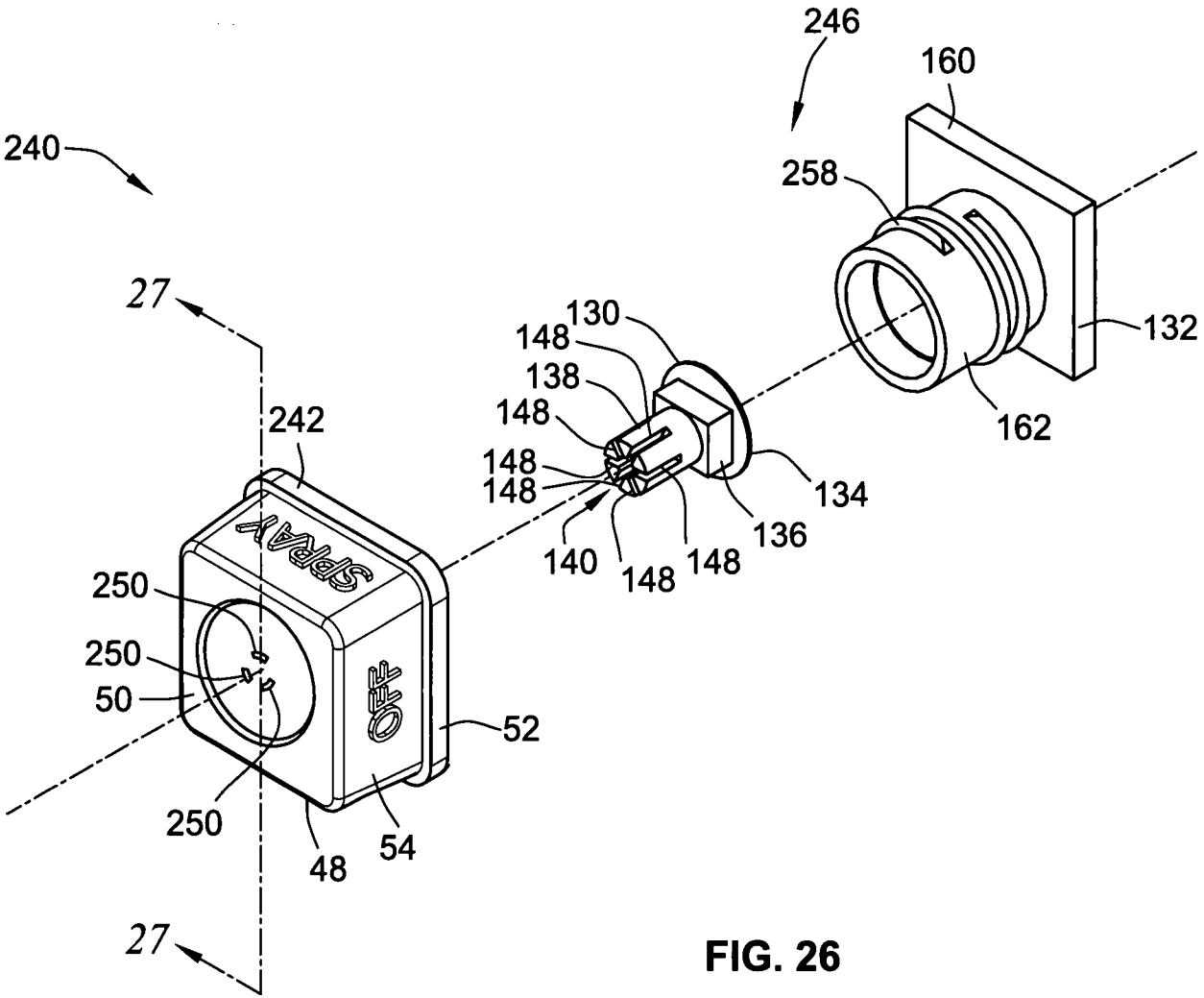
FIG. 26 is an exploded isometric view of another nozzle assembly according to the present invention.

The nozzle 42 is axially rotatable about the outer tubular wall 86 of the preference valve 44 between four successive functional positions: a first spray position, a first off position, a second spray position, and a second off position. In both off positions, as shown in FIGS. 17 and 20, for example, the recesses 64 in the central plug 62 of the nozzle 42 are not aligned with the openings 94 through the inner tubular wall 88 of the preference valve 44 to close the passageways 104 between the axial passageway 102 and the recessed channel 92. Consequently, liquid cannot flow from the cavity 170 into the recessed channel 92. However, in the first and second spray positions shown in FIGS. 13, 15, 18, and 19, for example, the recesses 64 in the central plug 62 are aligned with the openings 94 through the inner tubular wall 88 of the preference valve 44 to open the passageways 104 from the axial passageway 102 to the recessed channel 92. In this position, liquid is able to flow from the cavity 170 into the recessed channel 92.

With the liquid passageways 104 opened, liquid flows therethrough into the recessed channel 92, over the hump 96, and out an exit orifice. In the first spray position shown in FIG. 13, for example, the first exit orifice 56 is aligned over the hump 96 and the second exit orifice 58 is aligned over the wall 98. Liquid flows only through the first exit orifice 56 while the second exit orifice 58 is blocked by the wall 98. In the second spray position shown in FIG. 18, for example, the second exit orifice 58 is aligned over the hump 96 and the first exit orifice 56 is aligned over the wall 98. Liquid flows only through the second exit orifice 58 while the first exit orifice 56 is blocked by the wall 98.

More specifically, in the first spray position, a first liquid compression path is defined between the nozzle 42 and the preference valve 44. The first liquid compression path includes a first compression volume defined between the first exit orifice 56 and the hump 96. Similarly, in the second spray position, a second liquid compression path is defined between the nozzle 42 and the preference valve 44. The second liquid compression path includes a second compression volume defined between the second exit orifice 58 and the hump 96. The second compression volume is larger than the first compression volume because of the recess 68 in the end wall 50 of the nozzle 42 around the second exit orifice 58. Consequently, the second spray position projects a divergent spray pattern with droplets that have an average droplet size greater than in the first spray position.

In one example, the first and second spray positions produce sprays with an average droplet size generally less than about 120 microns and the average droplet size in the second spray position is approximately double the average droplet size in the first position. In another example, the second spray position produces a spray with an average droplet size generally between about 90 microns to about 120 microns and the first spray position produces a spray with an average droplet size generally between about 40 microns to about 60 microns. In yet a further example, the second spray position produces a spray with an average droplet size of about 100 microns and the first spray position produces a spray with an average droplet size of about 40 microns.

Another way to analyze the different spray positions of the nozzle assembly 40 is in terms of pressure drops and/or peak velocities associated with fluid flow through the nozzle assembly 40 in each of the spray positions. In one analysis, a steady flow of water at a flow rate between about 1-2 ml/sec, more specifically about 1.8 ml/sec, is simulated. Such a flow rate can be generated from a typical trigger sprayer, wherein a trigger pump stroke generates a flow of liquid having a volume of about 0.9 ml with a stroke time of about 0.5 seconds and an output of liquid between about 0.8 and 1.8 grams per trigger pump stroke. In the first spray position, the simulated flow of water is associated with a pressure drop between about 39-40 psi (about 269-276 kPa), more specifically about 39.1 psi (about 270 kPa), and has a peak velocity between about 22-23 m/s, more specifically about 22.8 m/s. In the second spray position, the simulated flow of water is associated with a pressure drop between about 15-16 psi (about 103-110 kPa), more specifically about 15.8 psi (about 109 kPa), and has a peak velocity between about 14-15 n/s, more specifically about 14.3 m/s. In this example, known computational fluid dynamics ("CFD") methods can be applied to these different pressure drops and peak velocities to estimate average droplet sizes in the first and second spray positions. According to one CFD method, the first spray position generates an output with a sauter mean diameter of about 44 microns and a most probable droplet diameter of about 51 microns, and the second spray position generates an output with a sauter mean diameter of about 94 microns and a most probable droplet diameter of about 108 microns. The sauter mean diameter is the diameter of a drop whose ratio of volume to the surface area is the same as that of the entire spray.

FIGS. 21-25 show another embodiment of a nozzle assembly 200 that is similar in structure and function to the nozzle assembly 40 of FIGS. 1-20 with differences as noted hereinafter. The nozzle assembly 200 includes a nozzle 202 disposed over a preference valve 204, which is further disposed over the outlet member 46 of FIG. 2. However, in other examples, different outlet members can be used that supply liquid from the dispensing end of a liquid dispenser to the nozzle. The nozzle 202 in the present example is substantially similar to the nozzle 42 of FIGS. 1-5 except that the end wall 50 is generally planar adjacent the cavity 60 and a single exit orifice 206 is disposed through the end wall 50. The preference valve 204 in the present example is substantially similar to the preference valve 44 of FIGS. 2 and 6-8 except that the recessed channel 92 includes a first hump 208 disposed between a first side of the opposed openings 94 and a second hump 210 disposed between a second opposite side of the opposed openings 94. In the present example, the first hump 208 has a greater height than the second hump 210. In contrast to the wall 98 of the preference valve 44, the second hump 210 allows liquid to flow thereby when the nozzle assembly is in a spray position, as will be described in more detail hereinafter.

In use, liquid flows through the aperture 166 in the base wall 160 of the valve body 132 and past an outer periphery of the discharge valve 130. Thereafter, the liquid flows through the channels 106 disposed in the inner tubular wall 88 and into the cavity 170. The nozzle assembly 200 of FIGS. 21-25 is also rotatable between four successive functional positions: a first spray position, a first off position, a second spray position, and a second off position. In the off positions, the recesses 64 in the central plug 62 of the nozzle 202 are not aligned with the openings 94 through the inner tubular wall 88 of the preference valve 204 and the passageways 104 between the axial passageway 102 and the recessed channel 92 are closed. Consequently, liquid does not flow from the cavity 170 into the recessed channel 92. However, in the first and second spray positions the recesses 64 in the central plug 62 are aligned with the opposed openings 94 through the inner tubular wall 88 of the preference valve 204 to open the liquid passageways 104 between the inner axial passageway 102 and the recessed channel 92. In this position, liquid is allowed to flow from the cavity 170 into the recessed channel 92.

With the liquid passageways 104 opened, liquid flows therethrough into the recessed channel 92 over the first or second humps 208, 210 and out the exit orifice 206. In the first spray position shown in FIG. 24, a first liquid compression path is defined with the exit orifice 206 aligned over the first hump 208 in the recessed channel 92. The first liquid compression path includes a first compression chamber with a first volume defined between the first hump 208 and the exit orifice 206. In the second spray position shown in FIG. 25, a second liquid compression path is defined with the exit orifice 206 aligned over the second hump 210. The second liquid compression path includes a second compression chamber with a second volume defined between the second hump 210 and the exit orifice 206. The second compression volume is larger than the first compression volume because the second hump 210 has a lesser height than the first hump 208. Consequently, the first spray position projects a divergent spray pattern that has a first average droplet size smaller than a second average droplet size of a divergent spray projected in the second spray position.

In one example, the first and second spray positions produce sprays with an average droplet size generally less than about 120 microns and the average droplet size in the second spray position is greater than the average droplet size in the first spray position.

Figure 27:
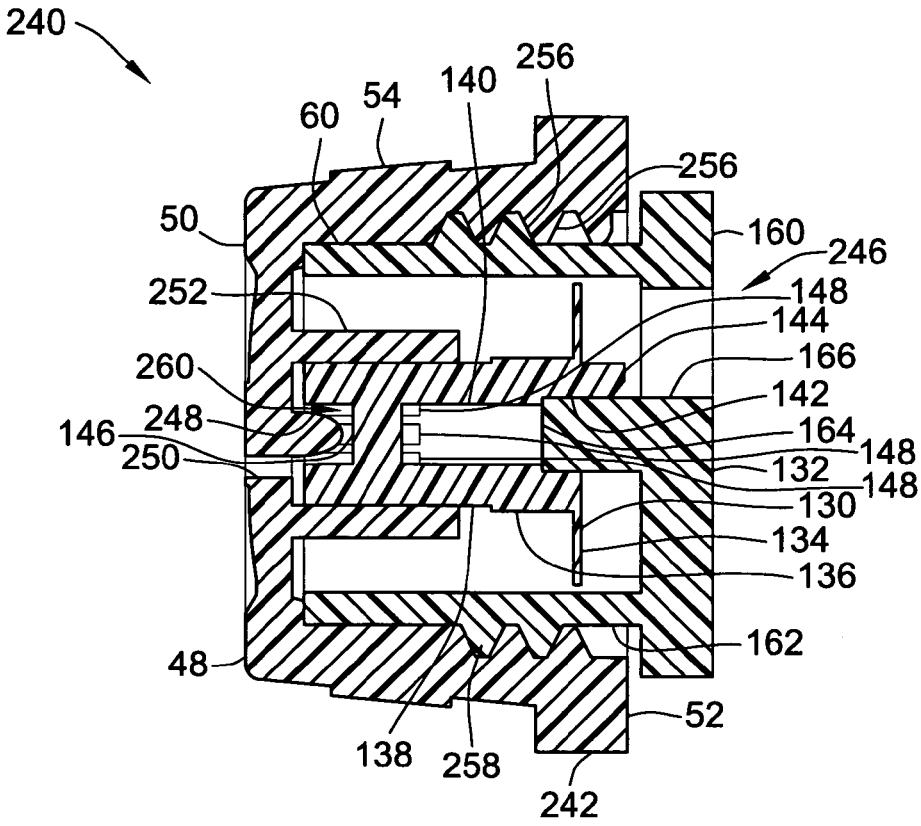
FIG. 27 is a cross-sectional view taken generally along lines 27-27 of FIG. 26 with the nozzle assembly in a first spray position.
Figure 28:
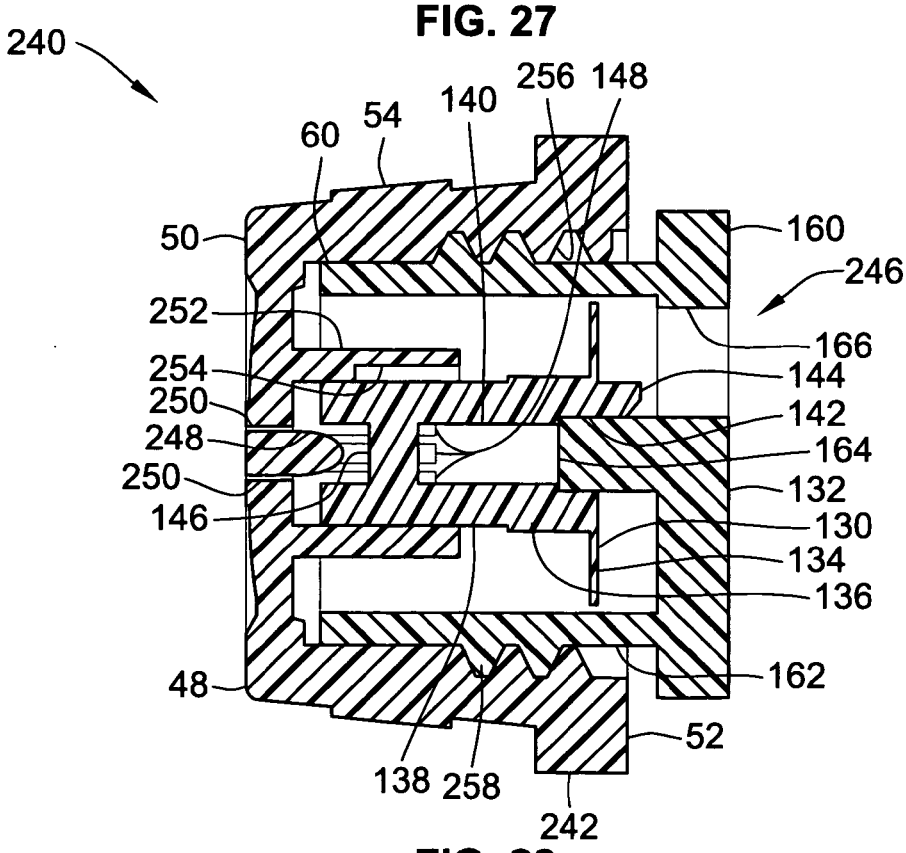
FIG. 28 is a cross-sectional view similar to FIG. 27 with the nozzle assembly in an off position.

FIGS. 26-29 show another embodiment of a nozzle assembly 240 that includes a nozzle 242 disposed over an outlet member 246. The outlet member 246 includes a preference valve 130 and a valve body 132 similar to the outlet member 46 of the previous embodiments. The nozzle 242 includes a central protrusion 248 that extends from the end wall 50 into the cavity 60 and a plurality of exit orifices 250 disposed around the central protrusion 248. Further, a generally tubular plug or sleeve 252 extends from the end wall 50 into the cavity 60. The sleeve 252 is radially spaced from the central protrusion 248 and includes one or more axial channels 254 that extend axially along an inner side of the sleeve 252, as shown in FIG. 28, for example. Further, the side wall 54 of the nozzle 242 includes a first screw thread 256 and the cylindrical column 162 of the valve body 132 includes a second screw thread 258 complementary to the first screw thread 256.

In use, the nozzle 242 is axially disposed over and around the valve body 132 so that the first screw thread 256 engages the second screw thread 258 and the sleeve 252 is disposed over and around the generally cylindrical member 138 of the discharge valve 130. Fluid flows through the aperture 166 in the base wall 160 of the valve body 132 and past an outer periphery of the discharge valve 130. The nozzle assembly 240 is rotatable between at least three functional positions: a first spray position, a first off position, and a second spray position. Additional successive off and spray positions may be possible depending, in part, on the lengths of the screw threads 256, 258 and the lengths of the nozzle 242 and the sleeve 252. In the off position, the axial channels(s) 254 in the sleeve 252 are not aligned with the axial channel(s) 148 in the cylindrical member 138 to prevent liquid from flowing to the exit orifices 250. However, in the first and second spray positions the axial channel(s) 254 in the sleeve 252 are aligned with the axial channel(s) 148 in the cylindrical member 138 to allow liquid to flow past the central protrusion 248 and out the exit orifices 250.

Figure 29:
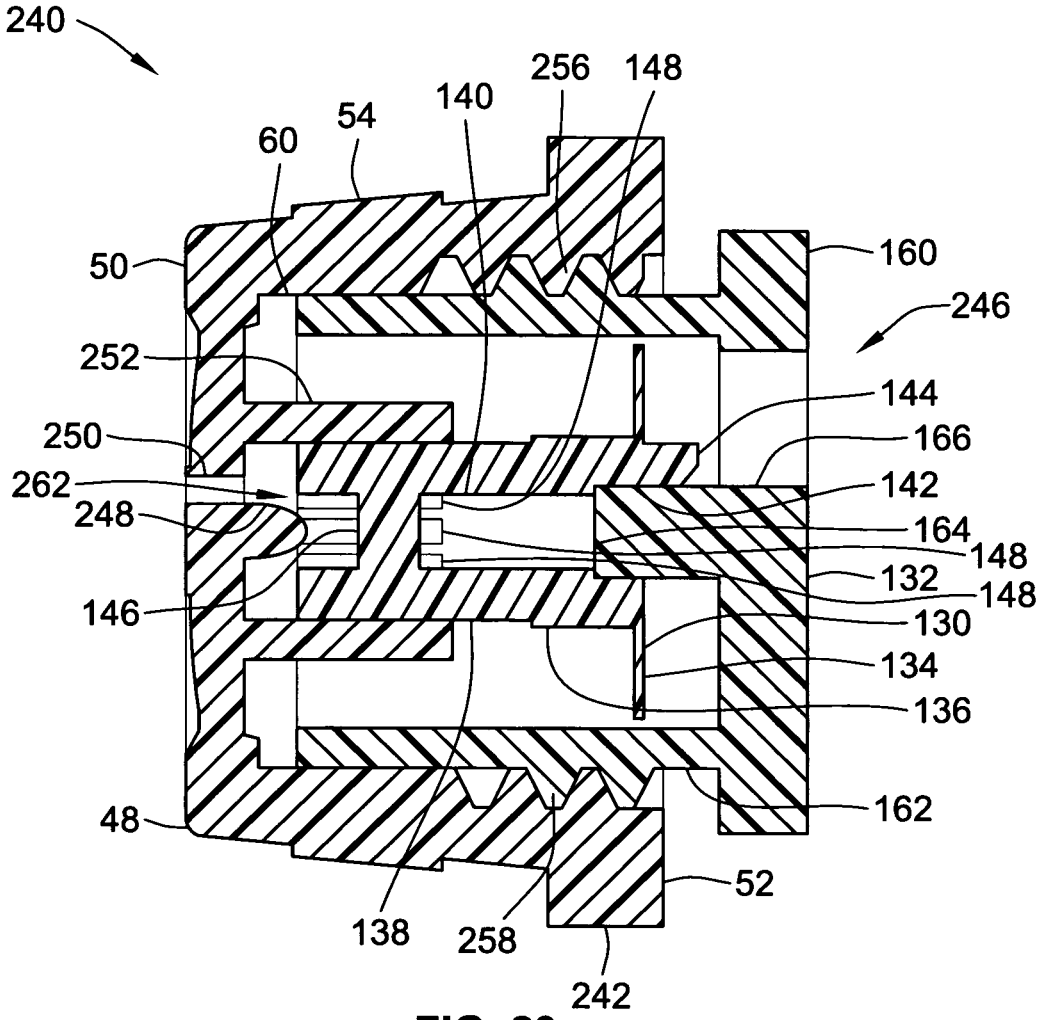
FIG. 29 is a cross-sectional view similar to FIG. 27 with the nozzle assembly in a second spray position.

By way of non-limiting example, FIGS. 27-29 illustrate the nozzle assembly 240 in the first and second spray positions and in an off position. More specifically, FIG. 27 illustrates the nozzle assembly 240 in the first spray position with the nozzle 242 disposed a first axial distance from the outlet member 246. The first spray position defines a first liquid compression path that includes a first compression chamber 260 between the nozzle 242 and a distal end of the discharge valve 130. Rotation of the nozzle 242 with respect to the outlet member 246 approximately 90 degrees clockwise positions the nozzle assembly 240 in the off position, an example of which is shown in FIG. 28. Further rotation of the nozzle 242 in the same direction with respect to the outlet member 246 approximately 90 degrees clockwise moves the nozzle assembly 240 from the off position to the second spray position shown in FIG. 29. In the second spray position, the nozzle 242 is disposed a larger second axial distance from the distal end of the discharge valve 130. Further, the second spray position defines a second liquid compression path that includes a second compression chamber 262 between the nozzle 242 and the discharge valve 246. Due to the interaction between first and second screw threads 256, 258 rotation of the nozzle 242 with respect to the outlet member 246 changes the axial distance that the nozzle 242 is disposed from the outlet member 246 and the distal end of the discharge valve 130. In the present example, the second distance is greater than the first distance and, in the off position, the nozzle 242 is disposed a third distance from the outlet member 246 that is between the first and second distances. Consequently, the first compression chamber 260 in the first spray position has a first volume that is smaller than the second compression chamber 262 in the second spray position. Thus, the second spray position projects a divergent spray pattern with droplets that have an average droplet size greater than in the first spray position.

In one example, the first and second spray positions produce sprays with an average droplet size generally less than about 120 microns and the average droplet size in the second spray position is greater than the average droplet size in the first position.

In all of the embodiments disclosed herein, a swirl chamber is preferably not formed in both the first and second spray positions. However, in some embodiments a swirl chamber could be formed, if desired. Thus, nozzle assemblies that include a swirl chamber or other vortex inducing structure can fall within the scope of this disclosure.

Other embodiments that include all of the possible different and various combinations of the individual features of each of the foregoing described examples are specifically included herein.

INDUSTRIAL APPLICABILITY

Nozzle assemblies disclosed herein are adapted to generate different divergent liquid spray outputs that have average droplet sizes less than about 120 microns. The different divergent liquid spray outputs are suited for applications where a liquid is being suspended in the air and/or applied to a surface.

Numerous modifications to the present invention will be apparent to those skilled in the art in view of the foregoing description. Accordingly, this description is to be construed as illustrative only and is presented for the purpose of enabling those skilled in the art to make and use the invention and to teach the best mode of carrying out same. The exclusive rights to all modifications that come within the scope of the appended claims are reserved.

We claim:

1. A nozzle assembly for a liquid dispenser, comprising:

an outlet member that defines a liquid supply conduit;

a nozzle that includes an exit orifice extending therethrough, wherein the nozzle is disposed over an end of the outlet member; and a liquid compression path defined by the nozzle and the outlet member, wherein the liquid compression path includes a liquid compression chamber that supplies liquid from the liquid supply conduit to the exit orifice, and a preference valve disposed between the outlet member and the nozzle, wherein the liquid compression chamber is defined between the preference valve and the nozzle, wherein the nozzle is adjustable between a first spray position for projecting a liquid spray having a first average droplet size and a second spray position for projecting a liquid spray having a second average droplet size greater than the first average droplet size, wherein in the first spray position the liquid compression chamber has a first volume and in the second spray position the liquid compression chamber has a second volume larger than the first volume, and wherein the liquid spray is formed without a swirl chamber directly upstream from the exit orifice and without injecting pressurized air into the fluid upstream of the exit orifice when the nozzle is in the first spray position and without injecting pressurized air into the fluid upstream of the exit orifice when the nozzle is in the second spray position, and wherein the nozzle includes a central plug projecting therefrom, and the central plug is disposed in an axial passageway of the preference valve, wherein an end wall of the nozzle includes axially extending ridges and the preference valve includes axially extending channels that interact with the ridges to block the exit orifice, and wherein the nozzle rotates independently of the preference valve.

2. The nozzle assembly of claim 1, wherein the nozzle includes a first exit orifice and a second exit orifice, and in the first spray position the first exit orifice is aligned with the compression path to form a first compression chamber having the first volume and the second exit orifice is blocked, and in the second spray position the second exit orifice is aligned with the compression path to form a second compression chamber having the second volume and the first exit orifice is blocked.

3. The nozzle assembly of claim 1, wherein the liquid compression path includes a first liquid compression chamber having the first volume and a second liquid compression chamber having the second volume, and in the first spray position the exit orifice is aligned with the first compression chamber to direct liquid therethrough and in the second spray position the exit orifice is aligned with the second compression chamber to direct liquid therethrough.

4. The nozzle assembly of claim 1, wherein the nozzle is rotatable about the preference valve and the preference valve includes an anti-rotation feature so that the preference valve is substantially rotatably fixed with respect to the outlet member.

5. The nozzle assembly of claim 1, wherein in the first spray position the nozzle is disposed a first axial distance from the outlet member and in the second spray position the nozzle is disposed a second axial distance from the outlet member greater than the first distance.

6. The nozzle assembly of claim 5, wherein the nozzle is adjustable to an off position that prevents the projection of a liquid spray, and wherein in the off position the nozzle is disposed a third axial distance from the outlet member between the first and second axial distances.

7. The nozzle assembly of claim 5, wherein the outlet member further includes a discharge valve that includes an end wall and a generally cylindrical member projecting axially from the end wall, wherein the cylindrical member has a central bore and a first axial channel that extends therethrough to the central bore, further wherein the nozzle includes an end wall, a central protrusion projecting from the end wall, at least one exit orifice disposed around the central protrusion, a sleeve radially spaced from the central protrusion and projecting from the end wall, and a second axial channel disposed along the sleeve, and wherein the sleeve is disposed over the cylindrical member of the discharge valve and the second axial channel is rotatably movable to align selectively with the first axial channel.

8. A nozzle assembly for a liquid dispenser, comprising:

an outlet member that defines a liquid supply conduit;

a nozzle that includes an exit orifice extending therethrough, wherein the nozzle is disposed over an end of the outlet member; and a liquid compression path defined by the nozzle and the outlet member, wherein the liquid compression path includes a liquid compression chamber that supplies liquid from the liquid supply conduit to the exit orifice, and a preference valve disposed between the outlet member and the nozzle, wherein the preference valve further includes an outer wall radially spaced from an inner wall defining an axial passageway, a channel extending axially along the inner wall adjacent the axial passageway, and an end wall extending between the outer and inner walls spaced from a discharge end of the preference valve to define a recessed channel, wherein the liquid compression chamber is defined between the preference valve and the nozzle and wherein liquid is supplied from the liquid supply conduit, through the channel and the axial passageway, through the recessed channel, to the liquid compression chamber, and out the exit orifice, wherein the nozzle is adjustable between a first spray position for projecting a liquid spray having a first average droplet size and a second spray position for projecting a liquid spray having a second average droplet size greater than the first average droplet size, wherein in the first spray position the liquid compression chamber has a first volume and in the second spray position the liquid compression chamber has a second volume larger than the first volume, and wherein the liquid spray is formed without a swirl chamber directly upstream from the exit orifice, and wherein the preference valve includes opposed openings through the inner wall proximate a discharge end of the preference valve, a hump disposed in the recessed channel of the preference valve between a first side of the opposed openings, and a wall that extends between an opposite second side of the opposed openings, wherein the wall substantially prevents liquid flow through the second side.

9. The nozzle assembly of claim 8, further comprising radially opposed openings through the inner wall proximate the discharge end of the preference valve, a first hump disposed in the recessed channel between a first side of the opposed openings, and a second hump disposed in the recessed channel between an opposite second side of the opposed openings, wherein the height of the first hump is greater than the height of the second hump.

10. The nozzle assembly of claim 9, wherein the nozzle includes an end wall, the exit orifice is axially offset and disposed through the end wall, and a central plug projects from the end wall and has two laterally opposed recesses, and wherein the central plug is disposed in the axial passageway of the preference valve.

11. The nozzle assembly of claim 8, wherein the nozzle includes an end wall with first and second diametrically aligned exit orifices disposed therethrough and a central plug projecting therefrom, and wherein an inner side of the end wall is recessed around the second exit orifice, and the central plug includes a recess and is disposed in the axial passageway of the preference valve.

12. The nozzle assembly of claim 11, wherein the end wall of the nozzle includes axially extending ridges disposed on opposite sides of each of the first and second exit orifices, and wherein the wall that extends between the second side of the opposed openings includes axially extending channels that interact with the ridges to block the second exit orifice in the second spray position and to block the first exit orifice in the first spray position.

13. A nozzle assembly for a liquid dispenser, comprising:

an outlet member that defines a liquid supply conduit;

a nozzle that includes an exit orifice, wherein the nozzle is disposed over an end of the outlet member; and a liquid compression path defined between the nozzle and the outlet member, wherein the liquid compression path includes a liquid compression chamber that supplies liquid from the liquid supply conduit to the exit orifice, a preference valve disposed between the outlet member and the nozzle, wherein the liquid compression chamber is defined between the preference valve and the nozzle, wherein the nozzle is adjustable between a first spray position for projecting a divergent liquid spray having a first average droplet size and a second spray position for projecting a divergent liquid spray having a second average droplet size greater than the first average droplet size, and wherein the first average droplet size is between about 40 micrometers and about 60 micrometers and the second average droplet size is between about 90 micrometers and about 120 micrometers, and wherein the liquid compression chamber is directly upstream of the exit orifice and provides a substantially unobstructed direct radial flow path to the exit orifice without injecting pressurized air into the fluid upstream of the exit orifice when the nozzle is in the first spray position and without injecting pressurized air into the fluid upstream of the exit orifice when the nozzle is in the second spray position, and wherein an end wall of the nozzle includes axially extending ridges and the preference valve includes axially extending channels that interact with the ridges to block the exit orifice.

14. The nozzle assembly of claim 13, wherein the end wall of the nozzle includes first and second exit orifices disposed therethrough, and wherein an inner side of the end wall is recessed around the second exit orifice and the second exit orifice is larger than the first exit orifice, and wherein in the first spray position the first exit orifice is aligned with a recessed channel of the preference valve and the second exit orifice is blocked, and in the second spray position the second exit orifice is aligned with the recessed channel and the first exit orifice is blocked.

* * * * *